US011971190B2

(12) United States Patent
Thompson et al.

(10) Patent No.: US 11,971,190 B2
(45) Date of Patent: Apr. 30, 2024

(54) DAMPER FOR HVAC SYSTEM

(71) Applicant: Air Distribution Technologies IP, LLC, Milwaukee, WI (US)

(72) Inventors: Cody Christopher Thompson, Overland Park, KS (US); Brian Gerard Bellerive, Louisburg, KS (US); Jeffrey Scott Beneke, Peculiar, MO (US); Kent Steven Maune, Independence, MO (US); Park Allen Wood, Raytown, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 102 days.

(21) Appl. No.: 17/669,268

(22) Filed: Feb. 10, 2022

(65) Prior Publication Data

US 2023/0250994 A1 Aug. 10, 2023

(51) Int. Cl.
*F24F 13/14* (2006.01)

(52) U.S. Cl.
CPC .... *F24F 13/1426* (2013.01); *F24F 2013/146* (2013.01)

(58) Field of Classification Search
CPC ..... F24F 13/1406; F24F 13/1426; F24F 2013/146; A62C 2/12; F16K 17/386; F16K 17/383; F16K 1/22; F16B 2/20–246
See application file for complete search history.

(56) References Cited

U.S. PATENT DOCUMENTS 4,146,048 A 3/1979 McCabe

FOREIGN PATENT DOCUMENTS

| | | | |
|---|---|---|---|
| AU | 745004 | B2 | 3/2002 |
| EP | 2823862 | B1 | 10/2016 |
| KR | 102239879 | B1 | 4/2021 |

*Primary Examiner* — Edelmira Bosques
*Assistant Examiner* — Michael James Giordano
(74) *Attorney, Agent, or Firm* — Fletcher Yoder, PC

(57) ABSTRACT

A damper assembly includes a frame having an inner surface and a protrusion extending inwardly relative to the inner surface, a damper blade coupled to the frame and configured to transition between an open position and a closed position, and a latch coupled to the inner surface of the frame. The latch is configured to deform to facilitate transition of the damper blade between the open position and the closed position and to expand to capture and retain the damper blade in the closed position, the latch includes a tab segment configured to move toward the protrusion during deformation of the latch and to move away from the protrusion during expansion of the latch, and a distal end of the tab segment overlaps with a thickness of the protrusion.

20 Claims, 14 Drawing Sheets

DAMPER FOR HVAC SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. The HVAC system may include ductwork through which air may flow, and the HVAC system may include a damper assembly configured to enable or block air flow through the ductwork. Unfortunately, it may be difficult to retain the damper assembly in a closed configuration to block air from flowing through the ductwork.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, A damper assembly includes a frame having an inner surface and a protrusion extending inwardly relative to the inner surface, a damper blade coupled to the frame and configured to transition between an open position and a closed position, and a latch coupled to the inner surface of the frame. The latch is configured to deform to facilitate transition of the damper blade between the open position and the closed position and to expand to capture and retain the damper blade in the closed position, the latch includes a tab segment configured to move toward the protrusion during deformation of the latch and to move away from the protrusion during expansion of the latch, and a distal end of the tab segment overlaps with a thickness of the protrusion.

In an embodiment, a latch for a damper assembly includes a first segment configured to be secured to an inner surface of a frame of the damper assembly, a second segment extending from the first segment and configured to extend away from the inner surface of the frame in an installed configuration of the latch with the damper assembly, the second segment configured to move relative to the first segment in the installed configuration, a third segment extending from the second segment and configured to extend toward the inner surface of the frame in the installed configuration, and a fourth segment extending from the third segment. The fourth segment is configured to extend at an oblique angle relative to the inner surface of the frame in the installed configuration, the third segment and the fourth segment at least partially define a recess of the latch, and the recess is configured to capture and retain a damper blade of the damper assembly in a closed position of the damper blade.

In an embodiment, a damper assembly includes a frame defining an air flow path of the damper assembly, the frame having an inner surface and a protrusion extending from the inner surface and into the air flow path, a blade assembly coupled to the frame and having a damper blade configured to rotate relative to the frame to transition between an open configuration and a closed configuration, and a latch having a first end and a second end. The first end is secured to the inner surface, the second end is configured to move relative to the first end, the second end comprises a distal end overlapping with a thickness of the protrusion, and the latch is configured to capture and retain the damper blade in the closed configuration

DRAWINGS

Various aspects of this disclosure may be better understood upon reading the following detailed description and upon reference to the drawings in which.

DETAILED DESCRIPTION

Figure 1:
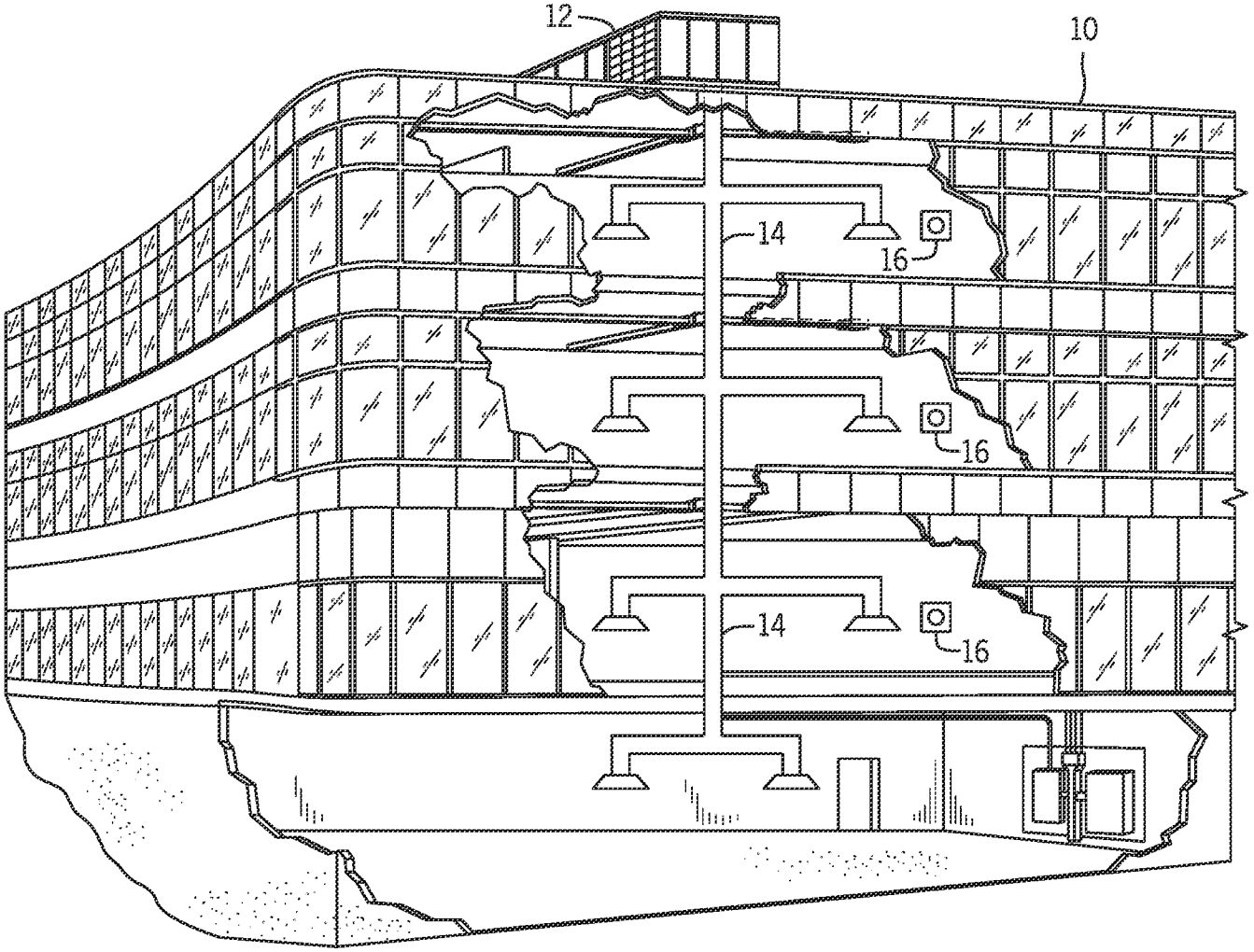
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a damper assembly that may be utilized in a heating, ventilation, and/or air conditioning (HVAC) system. The damper assembly may be a part of ductwork through which air may be directed. For example, the damper assembly may enable air to be directed from a space toward the HVAC system, such as to recirculate the air and enable the HVAC system to condition the air. Additionally or alternatively, the damper assembly may enable air (e.g., conditioned air) to be directed from the HVAC system into the space in order to condition the space.

In some circumstances, it may be desirable to block air from flowing through a portion of the ductwork. For example, it may be desirable to block contaminants, pollutants, or other unwanted particles in the air from flowing through the ductwork. Thus, the damper assembly may be configured to transition between an open configuration, in which the damper assembly enables air to flow through the ductwork, and a closed configuration, in which the damper assembly blocks air from flowing through the ductwork. In some circumstances, it may be desirable to retain the damper assembly in the closed configuration to maintain blockage of air flow through the damper assembly. Unfortunately, existing damper assemblies may not be configured to maintain the closed configuration in certain conditions. For example, the HVAC system may continue to operate and direct air toward and/or through the ductwork while the damper assembly is in the closed configuration, and the directed air may impart a force onto the damper assembly to urge the damper assembly toward the open configuration. As such, the damper assembly may undesirably enable air to flow through the ductwork.

Thus, it is presently recognized that maintaining the damper assembly in the closed configuration may improve blockage of air flow through the ductwork, as may be desired in certain conditions. Accordingly, embodiments of the present disclosure are directed to a damper assembly configured to maintain a closed configuration. For example, the damper assembly may include a frame that forms an opening through which air may flow. The damper assembly may also include one or more damper blades rotatably coupled to the frame. In the open configuration of the damper assembly, the one or more damper blades may be positioned so as to permit air to flow through the opening. In the closed configuration, the one or more damper blades may be positioned to cover the opening defined by the frame, thereby blocking air from flowing through the opening. To this end, the damper assembly may include a latch that may maintain the damper assembly in the closed configuration by retaining the damper blade in a position that blocks air flow through the damper assembly. In some embodiments, the latch may be secured to the frame and may capture the damper blade in the closed configuration of the damper assembly. In additional or alternative embodiments, the latch may be secured onto the damper blade and may capture a portion of the frame in the closed configuration of the damper assembly. Although the present disclosure primarily discusses damper blades configured to rotate relative to the frame of the damper assembly, additional or alternative embodiments of the damper assembly may include one or more damper blades that may be adjusted in a different manner to transition between a closed position and an open position, such as by translating or sliding relative to the frame.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

The present disclosure is directed to a damper assembly that may be utilized with or in an HVAC system. The damper assembly may include a frame and one or more damper blades coupled to and supported by the frame. The frame has an opening to enable air to flow through the damper assembly (e.g., through ductwork of the HVAC system into or out of a space within the building 10). The damper assembly may be configured to transition between an open configuration and a closed configuration to enable or block, respectively, the air from flowing through the damper assembly. For instance, in the open configuration, the damper blade may be oriented (e.g., relative to the frame) in an open position to expose the opening and enable air to flow through the damper assembly. In the closed configuration, the damper blade may be oriented (e.g., relative to the frame) in a closed position to cover the opening and block air from flowing through the damper assembly. Further, the damper assembly may include a latch configured to retain the damper blade in the closed configuration by blocking relative movement between the damper blade and the frame, such as by capturing the damper blade within a recess of the latch (e.g., with a latch coupled to the frame) and/or by capturing a portion of the frame within the recess of the latch (e.g., with a latch coupled to the damper blade). Thus, the latch may maintain the damper assembly in the closed configuration to block air from flowing through the damper assembly. Furthermore, upon application of a sufficient or threshold force on the latch, the latch may be configured to deform and/or compress to enable movement of the damper blade relative to the frame to transition between the closed position and the open position. For instance, a manual force of a sufficient or threshold magnitude may be applied to deform or actuate the latch to enable the damper blade to be moved from the closed position to the open position. As such, the latch may facilitate ease of transitioning the damper assembly between the closed configuration and the open configuration.

Figure 2:
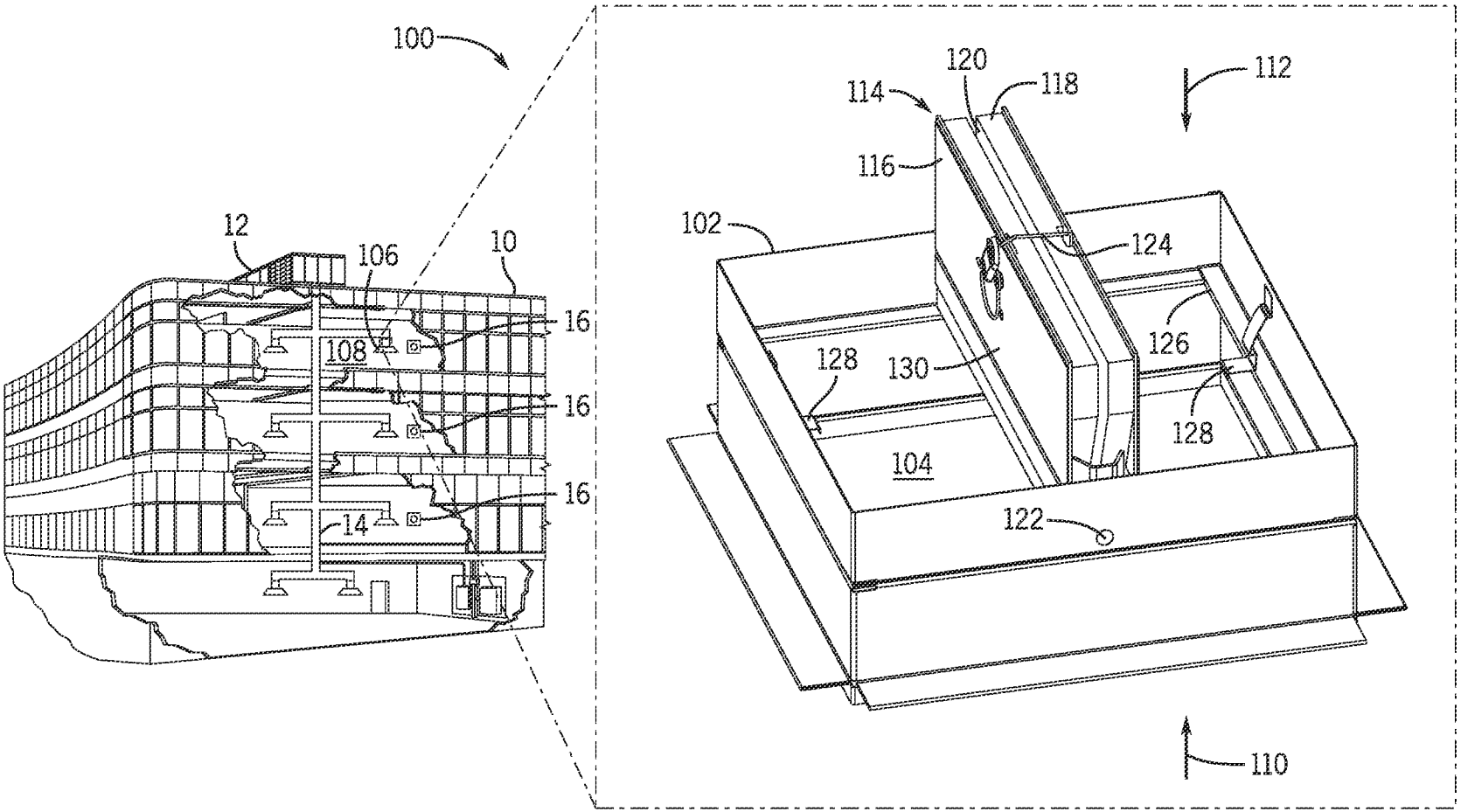
FIG. 2 is a perspective view of an embodiment of a damper assembly that may be incorporated in an HVAC system, in accordance with an aspect of the present disclosure.

With the preceding in mind, FIG. 2 is a perspective view of an embodiment of a damper assembly 100 that may be used in ductwork of an HVAC system, such as in the ductwork 14 connected to the HVAC unit 12 described above. The damper assembly 100 may include a frame 102, which may couple to and/or fit within the ductwork 14. Indeed, the frame 102 may include (e.g., define) an opening 104 (e.g., an air flow path) through which air may flow through, into, and/or out of the ductwork 14 in an installed configuration of the damper assembly 100. For example, the frame 102 may be positioned adjacent to an inlet/outlet 106 of the ductwork 14 to enable air (e.g., return air) to be directed out of a space 108 in the building 10 and into the ductwork 14 and/or to enable air (e.g., supply air) to be directed into the space 108 from the ductwork 14. In certain embodiments, the air may flow in a first flow direction 110 through the opening 104 of the frame 102 (e.g., from the space 108 into the ductwork 14 via the damper assembly 100, which may be positioned adjacent to an inlet of the ductwork 14). In additional or alternative embodiments, the air may flow in a second flow direction 112 through the opening 104 of the frame 102 (e.g., from the ductwork 14 into the space 108 via the damper assembly 100, which may be positioned adjacent to an outlet of the ductwork 14). The illustrated frame 102 has a square cross-sectional geometry, but additional or alternative embodiments of the frame 102 may have any suitably shaped geometry, such as a geometry that matches or corresponds with that of the ductwork 14, in order to block air from flowing between the frame 102 and the ductwork 14 and instead to direct air through the ductwork 14 via the opening 104.

In some circumstances, it may be desirable to block air flow through the opening 104 and therefore block air from flowing through a portion of the ductwork 14, such as to block air from flowing between the space 108 and the ductwork 14. For example, in certain circumstances, combustion products (e.g., smoke) may be present within the space 108 and/or within the ductwork 14, and it may be desirable to block the combustion products from flowing through the ductwork 14 (e.g., from the ductwork 14 toward the space 108 and/or toward other spaces 108) in order to mitigate spread of the combustion products throughout the building 10. To this end, the damper assembly 100 may include a blade assembly 114 that may transition between an open position (e.g., corresponding to an open configuration of the damper assembly 100) and a closed position (e.g., corresponding to a closed configuration of the damper assembly 100). In the illustrated embodiment, the blade assembly 114 is in the open position to expose the opening 104, thereby enabling air to be directed through the opening 104. In the closed position, the blade assembly 114 may cover, occlude, or fill the opening 104, thereby blocking air from flowing through the opening 104. For this reason, the blade assembly 114 may have a geometry that matches or corresponds to the geometry of the opening 104 when the blade assembly 114 is in the closed position.

In the illustrated embodiment, the blade assembly 114 includes a first damper blade 116 and a second damper blade 118. In the open position of the illustrated blade assembly 114, inner surfaces 120 (e.g., first surfaces) of the first damper blade 116 and the second damper blade 118 may be positioned adjacent to one another (e.g., to face one another, to form an acute angle between the inner surfaces 120). Further, the first damper blade 116 and the second damper blade 118 may be rotatably coupled to one another and/or to the frame 102. By way of example, the blade assembly 114 may include a mount, such as a bracket, (not shown) that is fastened to the frame 102 at a pivot 122 (e.g., defining a pivot point of the blade assembly 114). The first damper blade 116 and the second damper blade 118 may be configured to rotate about the pivot 122 to transition the blade assembly 114 between the open position and the closed position. To transition from the open position to the closed position of the blade assembly 114, the first damper blade 116 and the second damper blade 118 may rotate such that the inner surfaces 120 transition away from one another (e.g., to form an obtuse angle between the inner surfaces 120). As such, the first damper blade 116 and the second damper blade 118 may span across the opening 104 in the closed position of the blade assembly 114 to block air flow through the opening 104.

In some embodiments, the blade assembly 114 may include a link 124 configured to hold the first damper blade 116 and the second damper blade 118 in the illustrated configuration to maintain the blade assembly 114 in the open position. As described herein, deformation, rupture, and/or removal of the link 124 may cause the first damper blade 116 and the second damper blade 118 to rotate and transition from the open position to the closed position. In the closed position, the first damper blade 116 and/or the second damper blade 118 may abut against a protrusion 126 (e.g., a flange) of the frame 102 extending radially inward into the opening 104. The abutment between the protrusion 126 with the first damper blade 116 and/or the second damper blade 118 may create a seal (e.g., a sealing interface) that blocks air flow between the frame 102 and the blade assembly 114, thereby blocking air from flowing through the opening 104.

In certain embodiments, the damper assembly 100 may include one or more latches 128 configured to receive one of the first damper blade 116 or the second damper blade 118 in the closed position of the blade assembly 114. The latch 128 may, for instance, be coupled to the frame 102 and, when the blade assembly 114 transitions from the open position to the closed position, the latch 128 may capture a portion of one of the first damper blade 116 or the second damper blade 118 to maintain positioning of the first damper blade 116 and/or the second damper blade 118 adjacent to or against the protrusion 126. The latch 128 may therefore retain the blade assembly 114 in the closed position to block air from flowing through the opening 104 (e.g., by blocking movement of the first damper blade 116 and/or the second damper blade 118 away from the protrusion 126). Indeed, the latch 128 may be configured to retain the blade assembly 114 in the closed position despite application of a force onto the blade assembly 114, such as a force imparted by an air flow impinging on the blade assembly 114 (e.g., on the first damper blade 116 and/or the second damper blade 118). In embodiments in which air flows in the first flow direction 110, the latches 128 may be positioned at a downstream or discharge portion of the frame 102 (e.g., air flow being discharged from the damper assembly 100 may come into contact with the latches 128). In embodiments in which air flows in the second flow direction 112, the latches 128 may be positioned at an upstream or intake portion of the frame 102 (e.g., air flow entering the damper assembly 100 may come into contact with the latches 128). Although FIG. 2 illustrates two latches 128 configured to respectively capture the first damper blade 116 and the second damper blade 118 in the closed position of the blade assembly 114, the damper assembly 100 may include any suitable number of latches 128, such as one latch 128, or more than two latches 128 (e.g., multiple latches 128 configured to capture a single one of the damper blades 116, 118).

In some implementations, the blade assembly 114 may be manually transitioned from the closed position to the open position, thereby transitioning the damper assembly 100 from the closed configuration to the open configuration. As an example, a user (e.g., an operator, a technician, an occupant) may manually deform or actuate the latch 128 and move the blade assembly 114 while the latch 128 is deformed to rotate the first damper blade 116 and/or the second damper blade 118 relative to the frame 102 and/or relative to one another. Specifically, deformation of the latch 128 and application of a force onto the blade assembly 114 may release the first damper blade 116 and/or the second damper blade 118 from the latch 128 and move the inner surfaces 120 toward one another. To this end, a portion of the latch 128 and outer surfaces 130 of the first damper blade 116 and the second damper blade 118 may be exposed to the space 108 in the closed position of the blade assembly 114. Thus, the user in the space 108 may access the latch 128 and the outer surfaces 130 to release the first damper blade 116 and the second damper blade 118 from the latches 128 for transitioning the blade assembly 114 to the open position. In this manner, the damper assembly 100 may transition from the closed configuration to the open configuration without the use of a control system (e.g., an electronic controller), thereby reducing costs associated with the manufacture and/or the operation of the damper assembly 100.

Figure 3:
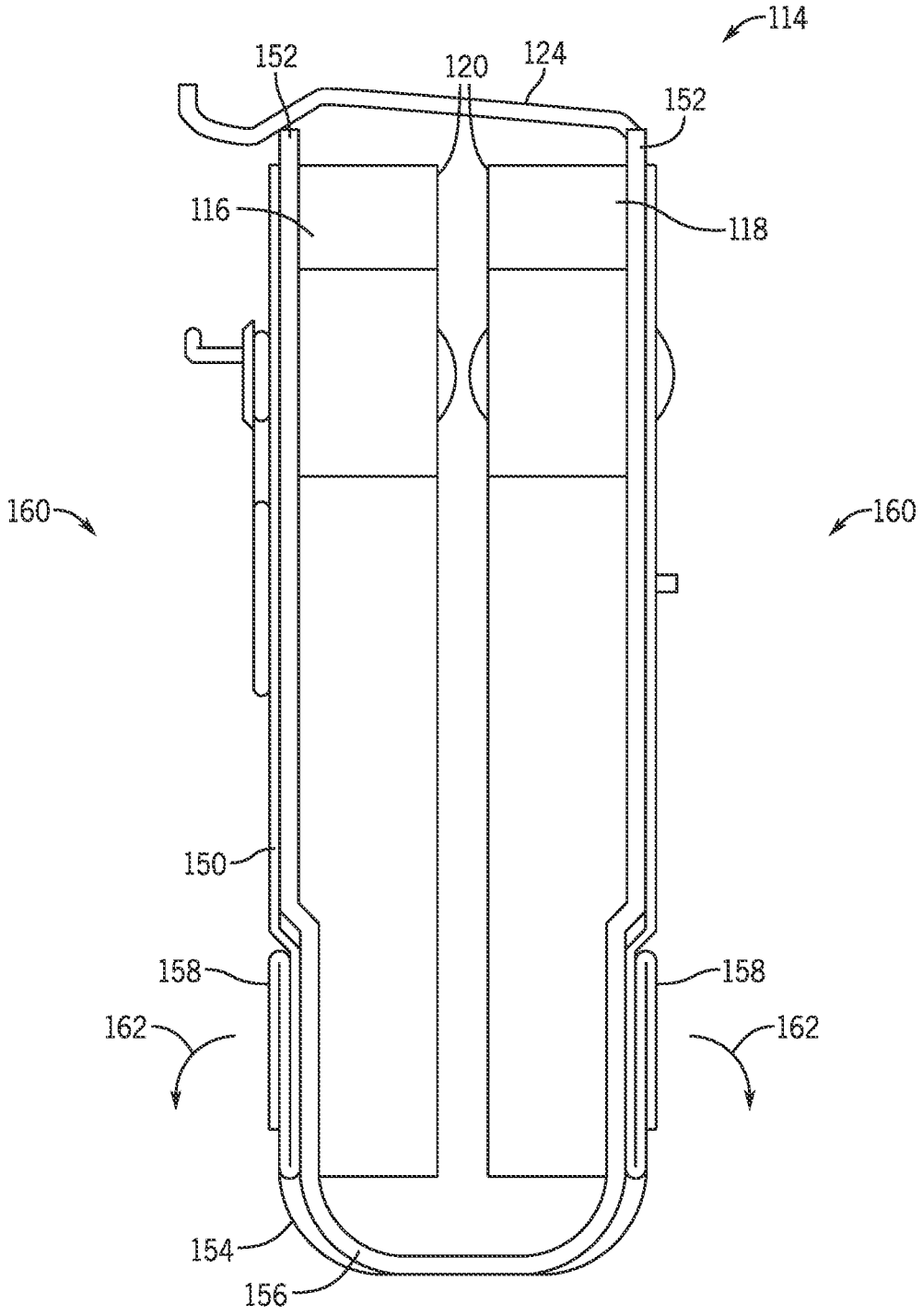
FIG. 3 is a side view of an embodiment of a blade assembly that may be incorporated in a damper assembly, in accordance with an aspect of the present disclosure.

FIG. 3 is a side view of an embodiment of the blade assembly 114 in the open position. Each of the first damper blade 116 and the second damper blade 118 may be coupled to a common support 150 (e.g., a support structure, a spine, etc.). The link 124 may couple to and span across first portions 152 (e.g., distal ends) of the blade assembly 114 to retain the blade assembly 114 in the open position. Thus, in the open position of the blade assembly 114, the support 150 may have a U-shaped configuration. Additionally, a hinge 154 (e.g., an integral spring hinge) may be attached to a second portion 156 (e.g., a center) of the support 150. The hinge 154 may impart a force onto the support 150 to bias the first portions 152 away from one another and move the blade assembly 114 toward the closed position. Thus, the link 124 coupled to the first portions 152 may resist or counteract the biasing force of the hinge 154 to retain the blade assembly 114 in the open position (e.g., by biasing the first portions 152 toward one another) and block the first portions 152 from moving away from one another.

The support 150 may include attachments 158 positioned on opposite sides 160 of the support 150 in the open position of the blade assembly 114. Each attachment 158 may include a slot in which ends of the hinge 154 may be inserted. For example, the hinge 154 may be crimped into the slots of the attachments 158, coupled to the support 150 via fasteners, or otherwise secured to the support 150 such that the hinge 154 is integral to the support 150 and/or blade assembly 114. Thus, the hinge 154 may also have a U-shaped configuration in the open position of the blade assembly 114. The ends of the hinge 154 may exert a torque onto the attachments 158 to urge the sides 160 of the support 150 to rotate in respective rotational directions 162 (e.g., to increase the angle between the inner surfaces 120 of the damper blades 116, 118).

As such, when the link 124 is removed or ruptured and therefore does not counteract or resist the biasing force of the hinge 154, the hinge 154 may cause the sides 160 of the support 150 to rotate away from one another (e.g., in the rotational directions 162), thereby transitioning the support 150 from the U-shape to a more level (e.g., flat) configuration associated with the closed position of the blade assembly 114. The level configuration (e.g., aligned configuration of the damper blades 116, 118) may enable the blade assembly 114 to span across the opening 104 and block air from flowing through the opening 104. The hinge 154 may continue to apply a force/torque against the attachments 158 to maintain the blade assembly 114 in the closed position. In certain embodiments, the link 124 may be made from a material (e.g., a metallic material) that deforms (e.g., plastically deforms) at a threshold temperature. That is, when the link 124 is exposed to the threshold temperature, the link 124 may deform, such as melt or rupture, to release the first portions 152 and cause the blade assembly 114 to transition to the closed position, thereby blocking air from flowing through the damper assembly 100.

In some embodiments, the hinge 154 may be manufactured, designed, selected, or otherwise implemented based on an application of the blade assembly 114. As an example, a thickness of the hinge 154 may be manufactured based on an expected rate of air flow directed through the opening 104, a material of the support 150, a size of the damper blades 116, 118, and so forth. In some embodiments, the hinge 154 may have a thickness that is greater than or equal to approximately 0.02 centimeters (0.008 inches) to provide a sufficient biasing force that enables transition and retention of the blade assembly 114 in the closed position, while enabling the blade assembly 114 to transition from the closed position to the open position via a manually applied force. For example, material properties and/or dimensions of the hinge 154 may be selected to enable the damper blades 116, 118 to resist movement upon application of a first force imparted by an air flow on the damper blades 116, 118, while also enabling movement of the damper blades 116, 118 upon application of a second force, greater than the first force, that may be manually applied to the damper blades 116, 118.

Figure 4:
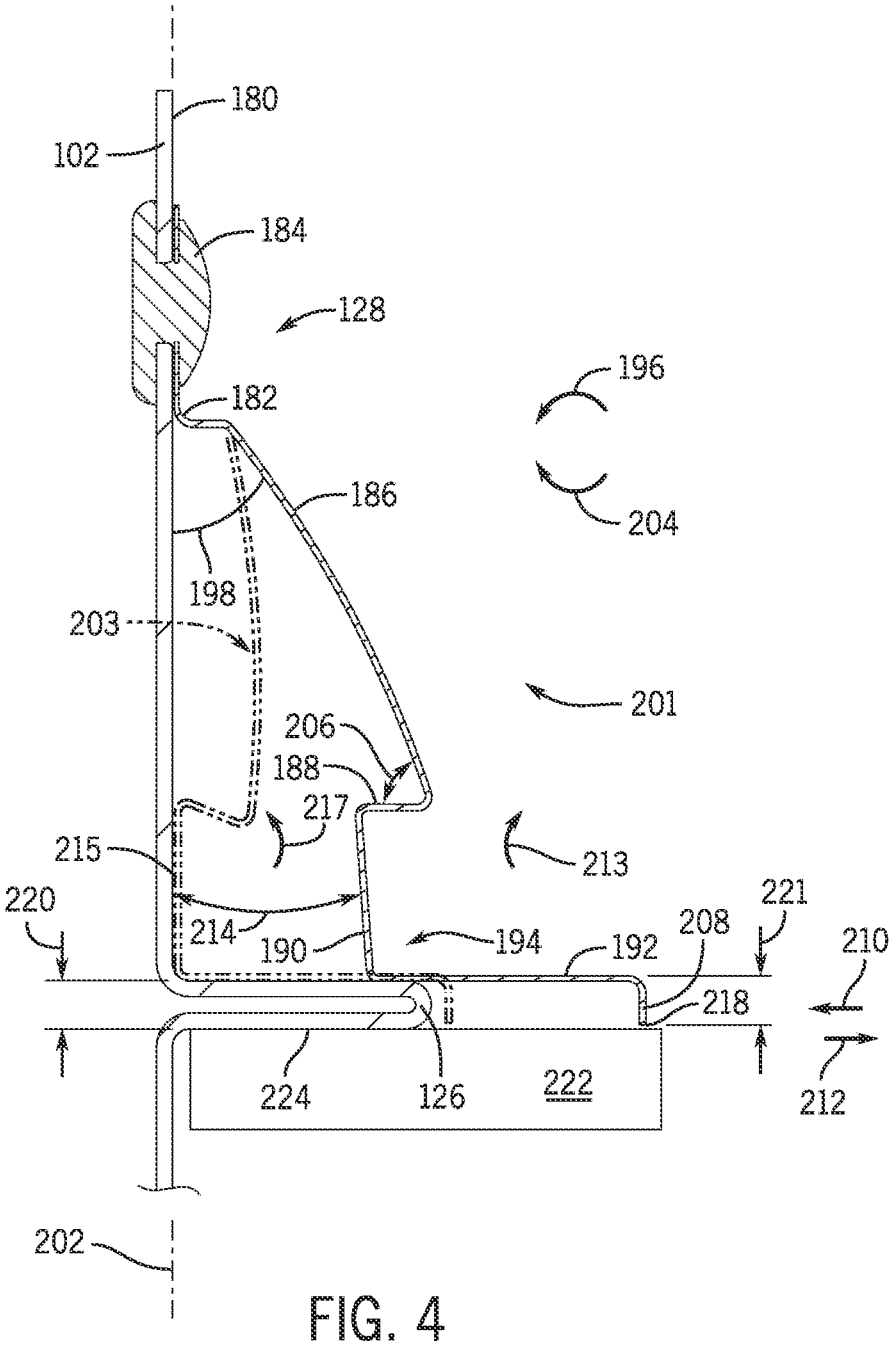
FIG. 4 is a side view of an embodiment of a latch incorporated in a damper assembly, in accordance with an aspect of the present disclosure.

FIG. 4 is a side view of an embodiment of the latch 128 installed with the damper assembly 100. The latch 128 is configured to capture one of the damper blades 116, 118 to retain the blade assembly 114 in the closed position. The latch 128 may be configured to engage an inner surface 180 of the frame 102 in an installed configuration of the latch 128. For example, the latch 128 may include a first segment 182 (e.g., a first end) configured to couple and be secured to the frame 102. In the illustrated embodiment, the first segment 182 is coupled to the frame 102 at the inner surface 180 via a fastener 184, such as a rivet. In additional or alternative embodiments, the first segment 182 may be coupled to the frame 102 using a different component, such as a weld, an adhesive, or other suitable securement feature. Thus, relative movement between the first segment 182 of the latch 128 and the frame 102 may be restricted. However, a remainder of the latch 128 may be movable or adjustable relative to the frame 102.

As an example, the latch 128 may include a second segment 186 (e.g., a crown segment) extending from the first segment 182 and away from the inner surface 180 in the installed configuration of the latch 128. The latch 128 may also include a third segment 188 extending from the second segment 186 and toward the inner surface 180 in the installed configuration, a fourth segment 190 extending from the third segment 188 (e.g., toward the protrusion 126 in the installed configuration), and a fifth segment 192 extending from the fourth segment 190 (e.g., away from the inner surface 180 in the installed configuration). Each of the second segment 186, the third segment 188, the fourth segment 190, and the fifth segment 192 may be movable relative to the frame 102 in the installed configuration of the latch 128 to enable the damper blade 116, 118 to transition between the open position and the closed position. The third segment 188, the fourth segment 190, and the fifth segment 192 may cooperatively form a recess 194 having a shape or geometry that may receive and capture one of the damper blades 116, 118 in the closed position of the blade assembly 114. In this way, unintentional removal of the damper blade 112, 114 from the recess 194 (e.g., via force applied by an air flow) is mitigated. Positioning of the damper blade 116, 118 within the recess 194 may further provide a seal or create a sealing interface between the damper blade 116, 118 and the latch 128 to block air from flowing between the damper blade 116, 118 and the frame 102 (e.g., via a void formed between the damper blade 116, 118 and the latch 128).

The second segment 186 may be shaped to enable deformation (e.g., compression) of the second segment 186 when the damper blade 116, 118 contacts and translates along the second segment 186 during rotation in a first rotational direction 196. For example, the second segment 186 may be arcuate (e.g., have a convex arc) to enable the deformation of the second segment 186 without undesirably changing a structural integrity (e.g., a shape, a geometry) of the second segment 186. Thus, the configuration of the second segment 186 may enable transition of the damper blade 116, 118 into the recess 194 to transition from the open position to the closed position. For instance, in the illustrated expanded configuration or position 201 of the latch 128, the second segment 186 may be sloped to form a first angle 198 relative to a vertical axis 202, such that abutment of the damper blade 116, 118 against the second segment 186 (e.g., as a result of movement in the first rotational direction 196) guides the damper blade 116, 118 to compress or bias the second segment 186 and to transition the latch 128 from the expanded configuration 201 to a deformed or compressed configuration or position 203 (e.g., in which the fourth segment 190 abuts the inner surface 180) shown in phantom lines. The deformed configuration 203 of the latch 128 may facilitate transition of the damper blade 116, 118 into the recess 194.

After the damper blade 116, 118 has been inserted within the recess 194, the second segment 186 and the third segment 188 may block the damper blade 116, 118 from being readily removed from the recess 194. For instance, after the damper blade 116, 118 is inserted into the recess 194, the latch 128 may transition from the deformed configuration 203 toward the expanded configuration 201 or a partially expanded configuration. In the expanded configuration 201 or the partially expanded configuration, the third segment 188 may be oriented relative to the second segment 186 to block rotation of the damper blade 116, 118 in a second rotational direction 204 out of the recess 194. Thus, the latch 128 may be maintained in a configuration that retains the damper blade 116, 118 within the recess 194 to maintain the damper assembly 114 in the closed configuration. As an example, in the expanded configuration 201 or the partially expanded configuration of the latch 128, the third segment 188 may form a second angle 206 (e.g., an acute angle) relative to the second segment 186 and overlap with the damper blade 116, 118 extending into the recess 194. Thus, as the third segment 188 overlaps with the damper blade 116, 118 in the expanded configuration 201, the latch 128 may block movement of the damper blade 116, 118 out of the recess 194.

The latch 128 may facilitate manual deformation of the second segment 186 to release the damper blade 116, 118 from the recess 194. To this end, the latch 128 may include a sixth segment 208 (e.g., a tab segment) extending from the fifth segment 192 (e.g., crosswise from the fifth segment 192 and to extension of the protrusion 126 from the inner surface 180). The sixth segment 208 may be actuated to move toward or away from the protrusion 126 of the frame 102 to deform the second segment 186 and transition the latch 128 between the expanded configuration 201 and the deformed configuration 203. To this end, the fifth segment 192 may be oriented parallel or substantially parallel to the protrusion 126, in some embodiments, to enable the fifth segment 192 to translate along the protrusion 126 and facilitate movement of the sixth segment toward or away from the protrusion 126. The sixth segment 208 may move or be moved to retain the damper blade 116, 118 within the recess 194 or to release the damper blade 116, 118 from the recess 194. By way of example, the user may impart a force onto the sixth segment 208 to move the sixth segment 208 in a first direction 210 toward the protrusion 126 to deform the second segment 186 and transition the latch 128 to the deformed configuration 203. In the deformed configuration 203, the second segment 186 and the third segment 188 may be offset or partially offset from the damper blade 116, 118 (e.g., to reduce or remove contact and/or overlap between the damper blade 116, 118 and the latch 128) to enable the damper blade 116, 118 to be removed from the recess 194. Absent the force imparted onto the sixth segment 208, the sixth segment 208 may move in a second direction 212 away from the protrusion 126 (e.g., via a spring force of the latch 128) to transition the latch 128 to the expanded configuration 201, such as after the damper blade 116, 118 has been inserted into the recess 194, to maintain the damper blade 116, 118 in the closed position. That is, in the expanded configuration 201, the third segment 188 may overlap with the damper blade 116, 118 to retain the damper blade 116, 118 within the recess 194 and restrict removal therefrom.

As discussed above, the third segment 188 may be oriented at the second angle 206 relative to the second segment 186 in the expanded configuration 201 of the latch 128. Furthermore, the fourth segment 190 may be oriented at a third angle 214 relative to the vertical axis 202 or a surface 215 (e.g., an inner surface) of the frame 102 in the expanded configuration 201. Movement of the sixth segment 208 in the first direction 210 toward the protrusion 126 may also cause the second segment 186, the third segment 188, and the fourth segment 190 to move in the first direction 210 as well (e.g., toward the surface 215). In this manner, while the damper blade 116, 118 remains stationary relative to the frame 102, movement of the sixth segment 208 toward the protrusion 126 may reduce an overlap between the latch 128 (e.g., the third segment 188 of the latch 128) and the damper blade 116, 118 during transition of the latch 128 to the deformed configuration 203, thereby facilitating movement of the damper blade 116, 118 into or out of the recess 194.

In addition, during transition of the latch 128 from the expanded configuration 201 to the deformed configuration 203, the fourth segment 190 may rotate in a third rotational direction 213 relative to the vertical axis 202. For example, movement of the sixth segment 208 toward the protrusion 126 may drive rotation of the fourth segment 190 about the third segment 188 in the third rotational direction 213. Additionally or alternatively, movement of the sixth segment 208 toward the protrusion 126 may cause the third segment 188 to rotate in a third rotational direction 213 about the second segment 186 relative to the vertical axis 202 to reduce the second angle 206. Rotation of the third segment 188 about the second segment 186 in the third rotational direction 213 may cause the rotation of the fourth segment 190 relative to the vertical axis 202 in the third rotational direction 213.

The rotation of the fourth segment 190 relative to the vertical axis 202 in the third rotational direction 213 may enable the fourth segment 190 to align with (e.g., extend generally parallel to) a surface 215 of the frame 102 in the deformed configuration 203. For example, in the deformed configuration 203, the fourth segment 190 may more fully abut the surface 215 (e.g., along a length of the fourth segment 190). Thus, the third angle 214 between the fourth segment 190 and the vertical axis 202 may be an oblique angle (e.g., 5 degrees, 10 degrees, 15 degrees, 20 degrees) in the expanded configuration 201, and the third angle 214 may be approximately a straight angle or zero angle (e.g., 0 degrees, 180 degrees) in the deformed configuration 203. In other words, the fourth segment 190 may be oriented crosswise relative to the surface 215 and/or the vertical axis 202 in the expanded configuration 201, and the fourth segment 190 may be flush with or substantially flush with the surface 215 in the deformed configuration 203. Indeed, the third angle 214 between the fourth segment 190 and the vertical axis 202 may be based on a travel distance of the latch 128 (e.g., in the first direction 210) between the expanded configuration 201 and the deformed configuration 203. Such movement and orientation of the fourth segment 190 relative to the surface 215 may enable increased movement of the latch 128 (e.g., of the second segment 186) in the first direction 210 toward the frame 102 during transition from the expanded configuration 201 to the deformed configuration 203. Thus, in the deformed configuration 203, the overlap between the latch 128 and the damper blade 116, 118 may be further reduced to facilitate movement of the damper blade 116, 118 into or out of the recess 194. In this way, the configuration of the latch 128 (e.g., relative arrangement of the second segment 186, third segment 188, and fourth segment 190) enables improved actuation of the latch 128 (e.g., from the extended configuration 201 to the deformed configuration 203), as well as improved selective transition of the damper blade 116, 118 from the closed position to the open position.

The fourth segment 190 may also rotate or pivot relative to the vertical axis 202 in a fourth rotational direction 217 (e.g., via a spring force of the latch 128) during transition of the latch 128 from the deformed configuration 203 to the expanded configuration 201 (e.g., corresponding to movement of the second segment 186 about the first segment 182 away from the frame 102). Such rotation of the fourth segment 190 may cause the fourth segment 190 to move farther toward the damper blade 116, 118 positioned within the recess 194. For example, rotation of the fourth segment 190 in the fourth rotational direction 217 may cause the fourth segment 190 to abut the damper blade 116, 118 in the expanded or partially expanded configuration 201. Abutment between the fourth segment 190 and the damper blade 116, 118 may further block movement of the damper blade 116, 118 relative to the latch 128 (e.g., in the second rotational direction 204) to retain the damper blade 116, 118 within the recess 194.

Furthermore, an end 218 (e.g., a distal end) of the sixth segment 208 may extend within (e.g., partially across) and/or overlap with a thickness or depth 220 of the protrusion 126. In other words, the sixth segment 208 may not extend beyond the protrusion 126 from the fifth segment 192. For instance, a length 221 of the sixth segment 208 may be less than the thickness 220 of the protrusion 126. In this manner, the latch 128 may facilitate improved assembly and/or installation of the damper assembly 100. For example, a component 222, such as a grille, may engage with and/or be disposed against an underside 224 of the protrusion 126 (e.g., to couple or mount to the frame 102) without interference from the sixth segment 208. Thus, the latch 128 may be incorporated with the damper assembly 100 and also enable engagement between the frame 102 and the component 222.

Figure 5:
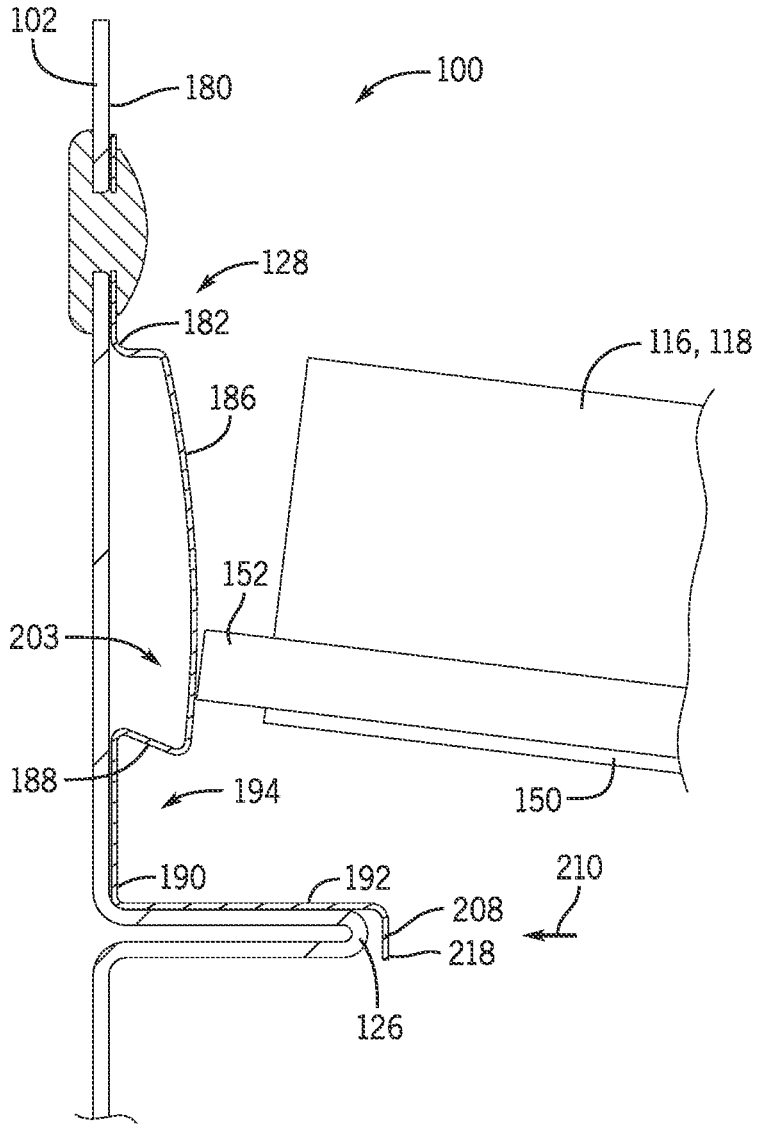
FIG. 5 is a partial side view of an embodiment of a damper assembly, illustrating a damper blade of a blade assembly transitioning between a closed position and an open position, in accordance with an aspect of the present disclosure.

FIG. 5 is a partial side view of an embodiment of the damper assembly 100, illustrating the latch 128 in the installed configuration and transition or passage of one of the damper blades 116, 118 between the closed position and the open position. The transition between the closed position and the open position may cause the damper blade 116, 118 to contact and deform the second segment 186 of the latch 128. Such deformation of the second segment 186 may move the second segment 186, the third segment 188, the fourth segment 180, the fifth segment 192, and the sixth segment 208 toward the inner surface 180 of the frame 102, thereby transitioning the latch 128 to the deformed configuration 203. As an example, deformation of the second segment 186 may cause the second segment 186 to move (e.g., bend, pivot, rotate) relative to the first segment 182 and cause the sixth segment 208 to move in the first direction 210 toward the protrusion 126.

Figure 6:
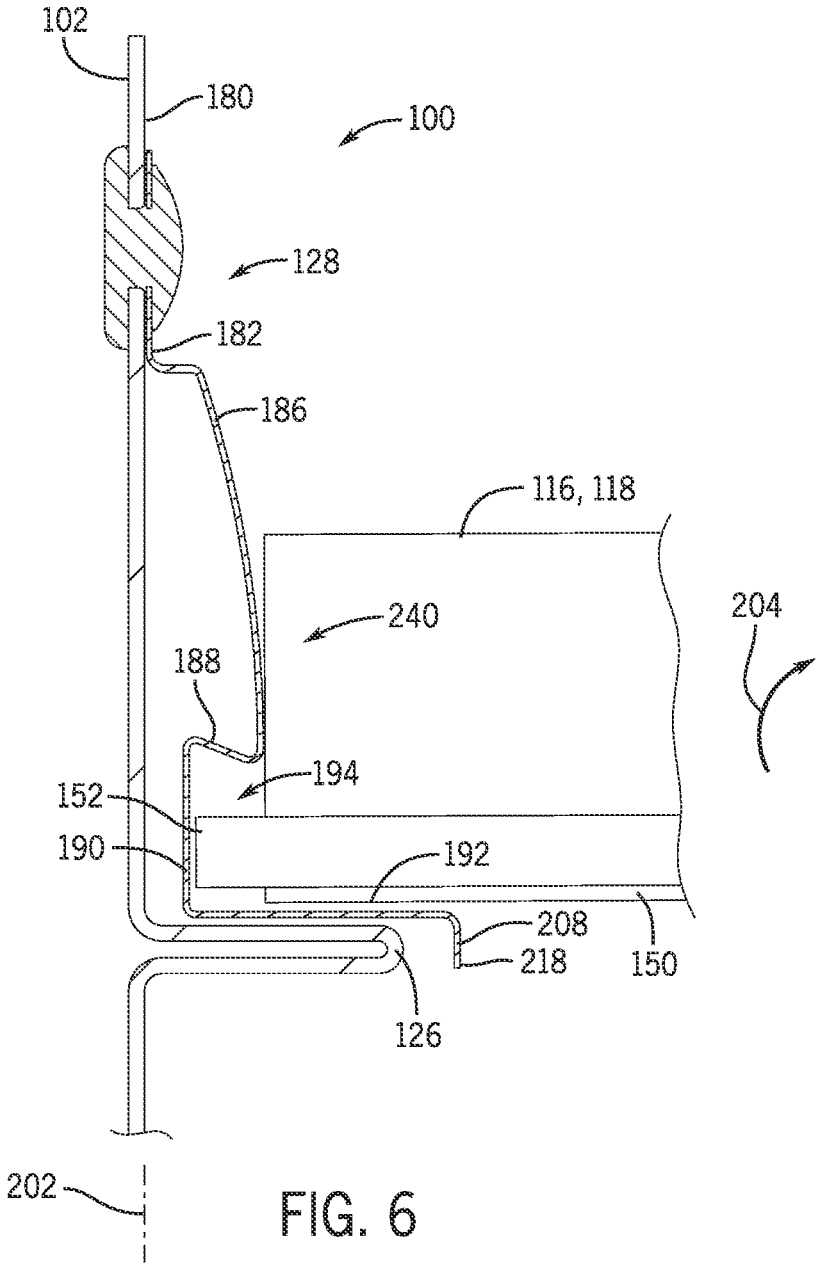
FIG. 6 is a partial side view of an embodiment of a damper assembly, illustrating a damper blade of a blade assembly in a closed position, in accordance with an aspect of the present disclosure.

FIG. 6 is a partial side view of an embodiment of the damper assembly 100 illustrating one of the damper blades 116, 118 in the closed position of the blade assembly 114. That is, the damper blade 116, 118 is disposed within the recess 194, such as after transitioning across the second segment 186. With the damper blade 116, 118 disposed within the recess 194, the latch 128 may transition from the deformed configuration 203 toward the expanded configuration 201 (e.g., absent any additional force retaining the latch 128 in the deformed configuration 203, such as a force applied to the sixth segment 218). Indeed, contact between the damper blade 116, 118 (e.g., the first portion 152 of the blade assembly 114) and the latch 128 during transition of the blade assembly 114 between the open position and the closed position may cause the latch 128 to undergo elastic deformation, which enables the latch 128 to transition back toward the expanded configuration 201 once the damper blade 116, 118 (e.g., the first portion 152 of the blade assembly 114) is disposed within the recess 194. In the illustrated embodiment, the damper blade 116, 118 blocks the latch 128 from full movement to the expanded configuration 201. Thus, the latch 128 may be in a partially expanded configuration 201 while the damper blade 116, 118 is in the recess 194. As shown in the deformed configuration 203 and/or partially expanded configuration, with the damper blade 116, 118 positioned within the recess 194, the third segment 188 and the first portion 152 of the damper blade 116, 118 overlap with one another (e.g., relative to vertical axis 202). The overlap between the third segment 188 and the first portion 152 may cause abutment between the third segment 188 and the damper blade 116, 118 (e.g., during rotation of the damper blade 116, 118 in the second rotational direction 204) to block movement of the damper blade 116, 118 out of the recess 194 and retain the damper blade 116, 118 in the closed position.

Moreover, the second segment 186 and/or the fourth segment 190 may contact or abut the damper blade 116, 118 in the partially expanded configuration. Such engagement between the latch 128 and the damper blade 116, 118 in the closed position of the blade assembly 114 may provide or create a seal therebetween that blocks air from flowing between the damper blade 116, 118 and the latch 128 (e.g., between the damper blade 116, 118 and the fourth segment 190, between the damper blade 116, 118 and the second segment 186). Further, such engagement between the latch 128 and the damper blade 116, 118 in the closed position of the blade assembly 114 may block movement of the blade assembly 114 relative to the latch 128 to retain the blade assembly 114 in the closed position.

Figure 7:
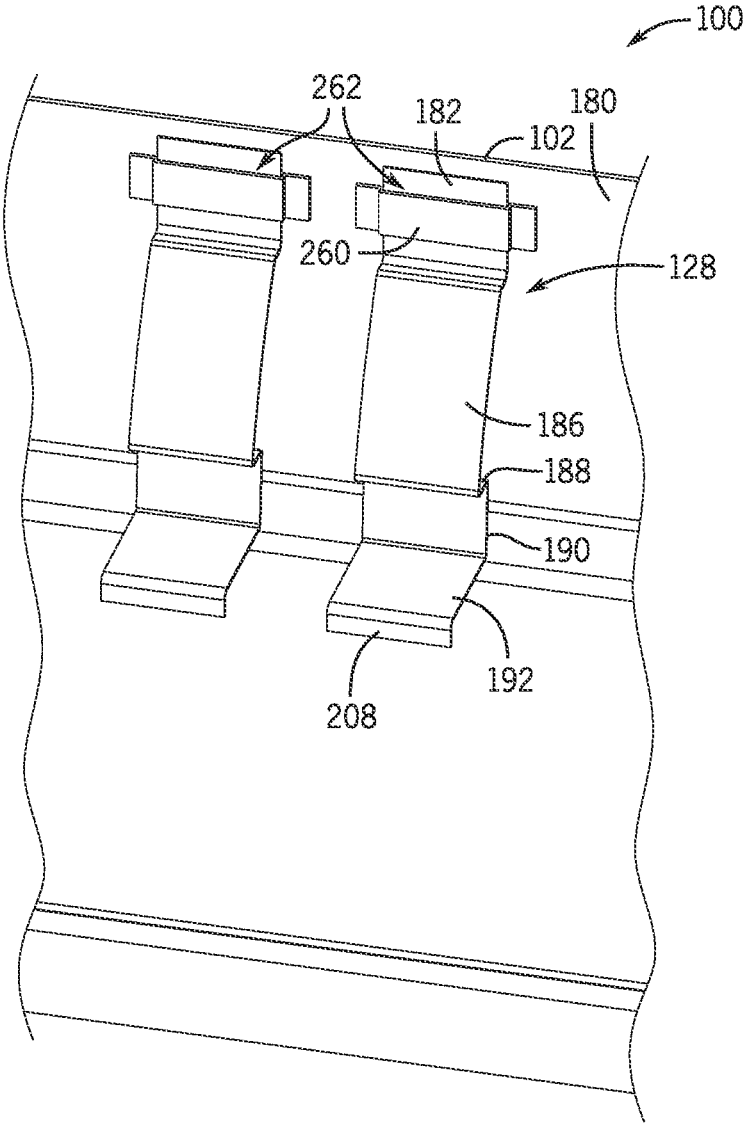
FIG. 7 is a perspective view of an embodiment of a latch incorporated in a damper assembly, in accordance with an aspect of the present disclosure.

FIG. 7 is a perspective view of an embodiment of the damper assembly 100, illustrating latches 128 coupled to the frame 102. In the illustrated embodiment, the latches 128 are secured to the frame 102 via features formed in the frame 102. For example, the frame 102 may include louvers 260 or other surface formations formed therein that extend away from the inner surface 180 of the frame 102, thereby forming an opening 262 (e.g., a passage, a slot) between the louver 260 and the inner surface 180. The first segment 182 of the latch 128 may be inserted through the opening 262 to couple the latch 128 to the frame 102. For example, the louver 260 may be formed to capture the first segment 182 within the opening 262 and block relative movement between the first segment 182 and the frame 102 in order to secure the latch 128 to the frame 102. In some embodiments, the louvers 260 may be integrally formed with the frame 102. As an example, the louvers 260 may be formed via deformation of the frame 102 (e.g., via a punch, via a press). In additional or alternative embodiments, the louvers 260 may be separate components from the frame 102 and may be coupled or mounted to the inner surface 180, such as via a weld, an adhesive, a fastener, and the like.

Figure 8:
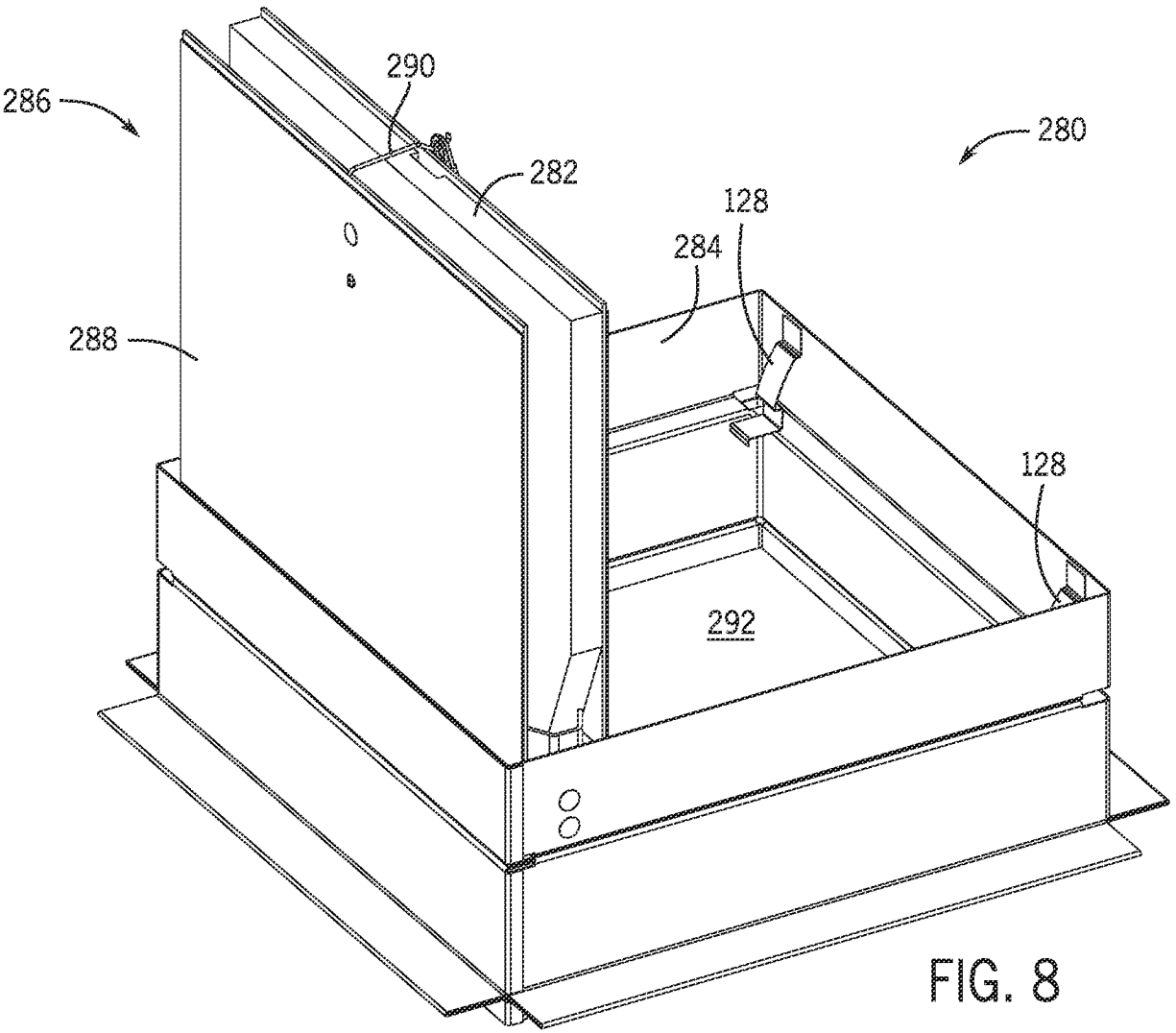
FIG. 8 is a perspective view of an embodiment of a damper assembly that may be incorporated in an HVAC system, in accordance with an aspect of the present disclosure.

FIG. 8 is a perspective view of an embodiment of a damper assembly 280 having a single damper blade 282. The damper assembly 280 may include a frame 284 and a blade assembly 286 with the single damper blade 282, which may be rotatably coupled to the frame 284. The damper assembly 280 may include a backing 288 (e.g., a support, a plate, a sheet, a panel, a board) that is fixedly coupled to the frame 284. In the open position of the blade assembly 286 (e.g., in the open configuration of the damper assembly 280), a link 290 may couple the damper blade 282 to the backing 288. That is, the link 290 may secure or retain the damper blade 282 against and/or adjacent to the backing 288. Upon deformation, rupture, and/or removal of the link 290 (e.g., plastic deformation of the link 280 caused by exposure to a threshold temperature), the damper blade 282 may rotate relative to the frame 284 and relative to the backing 288 to the closed position. For example, the blade assembly 286 may include a hinge (not shown) coupling the damper blade 282 to the backing 288 and/or to the frame 284. The hinge may impart a biasing force that rotates the blade assembly 286 away from the backing 288 to span across an opening 292 formed by the frame 284, thereby blocking air from flowing through the frame 284.

The damper assembly 280 may include one or more latches 128 that may capture the damper blade 282 and retain the damper blade 282 in the closed position of the blade assembly 286, as similarly described above. The latches 128 may also enable the blade assembly 286 to transition from the closed position to the open position upon transitioning the latches 128 to the deformed configuration 203 (e.g., via a manually applied force) and a force applied to the damper blade 282. Therefore, the latches 128 may enable the blade assembly 286 to be positioned and retained, as desired, in the closed position or in the open position. Although the illustrated damper assembly 280 includes two latches 128, the damper assembly 280 may include any suitable number of latches 128 to retain the blade assembly 286 in the closed position.

Figure 9:
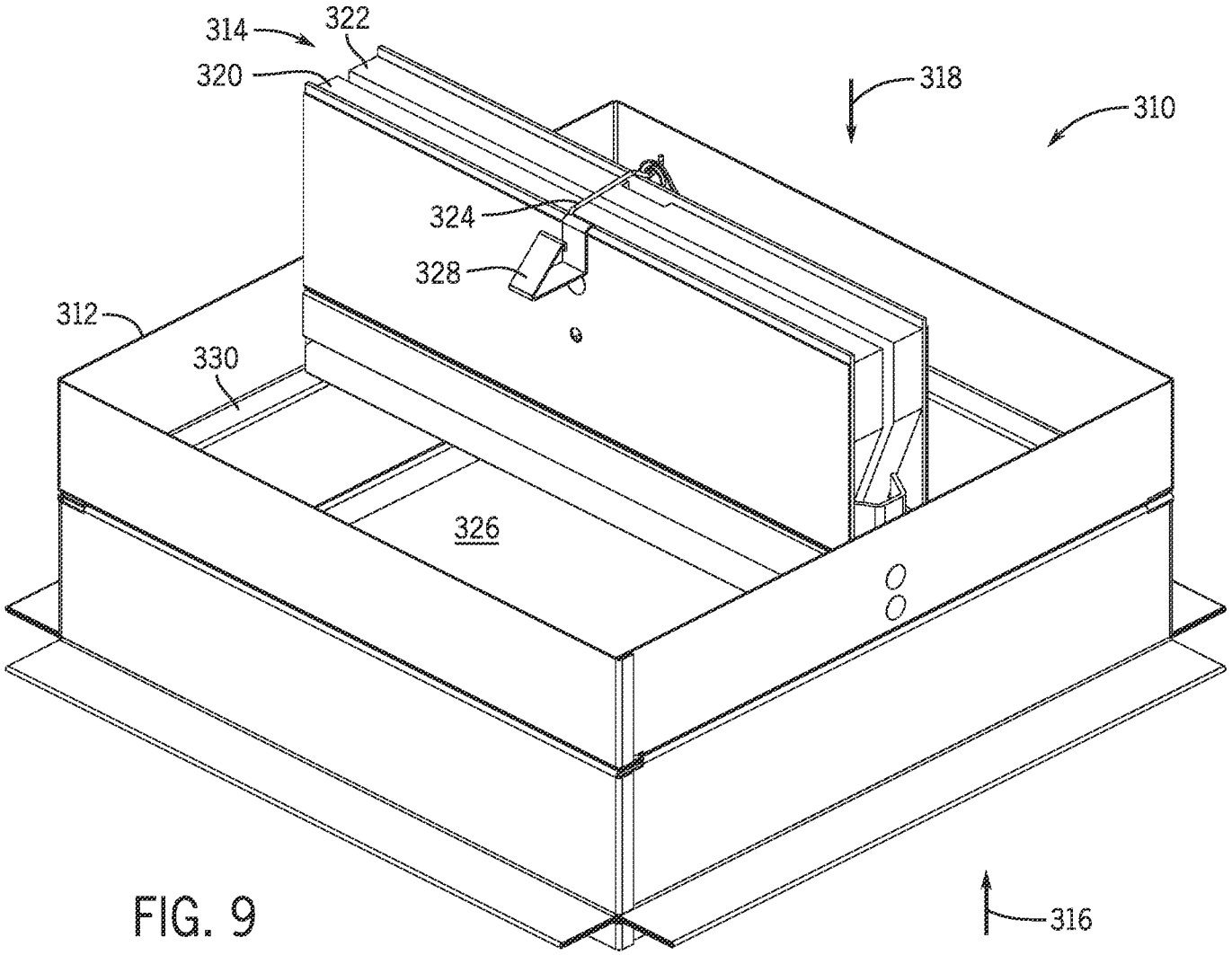
FIG. 9 is a perspective view of an embodiment of a damper assembly that may be incorporated in an HVAC system, in accordance with an aspect of the present disclosure.

FIG. 9 is a perspective view of an embodiment of a damper assembly 310 having a frame 312 and a blade assembly 314 rotatably coupled to the frame 312. Air may flow through the damper assembly 310 in a first flow direction 316 (e.g., into the ductwork 14) and/or in a second flow direction 318 (e.g., out of the ductwork 14), and the blade assembly 314 may transition between the open configuration and the closed configuration to enable or block air flow through the damper assembly 310, respectively. For example, the blade assembly 314 may include a first damper blade 320 and a second damper blade 322 configured to transition between the closed position and the open position in accordance to the techniques described above to transition the damper assembly 310 between the closed configuration and the open configuration. The blade assembly 314 may include a link 324 configured to hold the first damper blade 320 and the second damper blade 322 (e.g., to bias the damper blades 320, 322 toward, adjacent, and/or against one another) to maintain the blade assembly 314 in the illustrated open position. Deformation and/or rupture of the link 324 (e.g., caused by exposure to a temperature above a threshold temperature) may cause the first damper blade 320 and the second damper blade 322 to rotate and transition from the open position to the closed position to block air flow through the damper assembly 310 via an opening 326 defined by the frame 312.

In the illustrated embodiment, the damper assembly 310 includes a latch 328 coupled to (e.g., secured to, fixedly couple to) the first damper blade 320 in an installed configuration of the latch 328. The latch 328 may maintain the blade assembly 314 in the closed position. For instance, the frame 312 may include a protrusion 330 (e.g., a flange) extending radially inward into the opening 326, and the latch 328 may be configured to engage with the protrusion 330 in the closed position of the blade assembly 314. For example, in the closed position of the blade assembly 314, the latch 328 may capture a portion of the protrusion 330 to block movement between the first damper blade 320 and the frame 312 by restricting movement between the latch 328 and the protrusion 330 (e.g., to block movement of the first damper blade 320 away from the protrusion 330 caused by an air flow impinging on the blade assembly 314). Thus, the latch 328 may facilitate blocking air from flowing through the opening 326 while the damper assembly 310 is in the closed configuration. In embodiments in which air flows in the first flow direction 316, the latch 328 may be positioned at an upstream or intake portion of the damper assembly 310 (e.g., on an upstream side of the first damper blade 320, when the blade assembly 314 is in the closed position, relative to the first flow direction 316 through the damper assembly 310). In embodiments in which air flows in the second flow direction 318, the latch 328 may be positioned at a downstream or discharge portion of the damper assembly 310 (e.g., on a downstream side of the first damper blade 320, when the blade assembly 314 is in the closed position, relative to the second flow direction 318 through the damper assembly 310). Although the illustrated damper assembly 310 includes a single latch 328 coupled to the first damper blade 320, in additional or alternative embodiments, the damper assembly 310 may include multiple latches 328 coupled to the first damper blade 320, one or more latches 328 coupled to the second damper blade 322, latches (e.g., the latch 128) coupled to the frame 312, or any combination thereof.

In certain embodiments, the blade assembly 314 may be manually transitioned from the closed position to the open position. For instance, when the blade assembly 314 is in the closed position, the latch 328 may be accessible to a user (e.g., within the space 108), and the user may deform or actuate the latch 328 to disengage the latch 328 from the protrusion 330 and enable relative movement between the first damper blade 320 and the frame 312. The user may then apply a manual force to the first damper blade 320 while the latch 328 is deformed to rotate the first damper blade 320 (e.g., away from the protrusion 330) to the open position.

Figure 10:
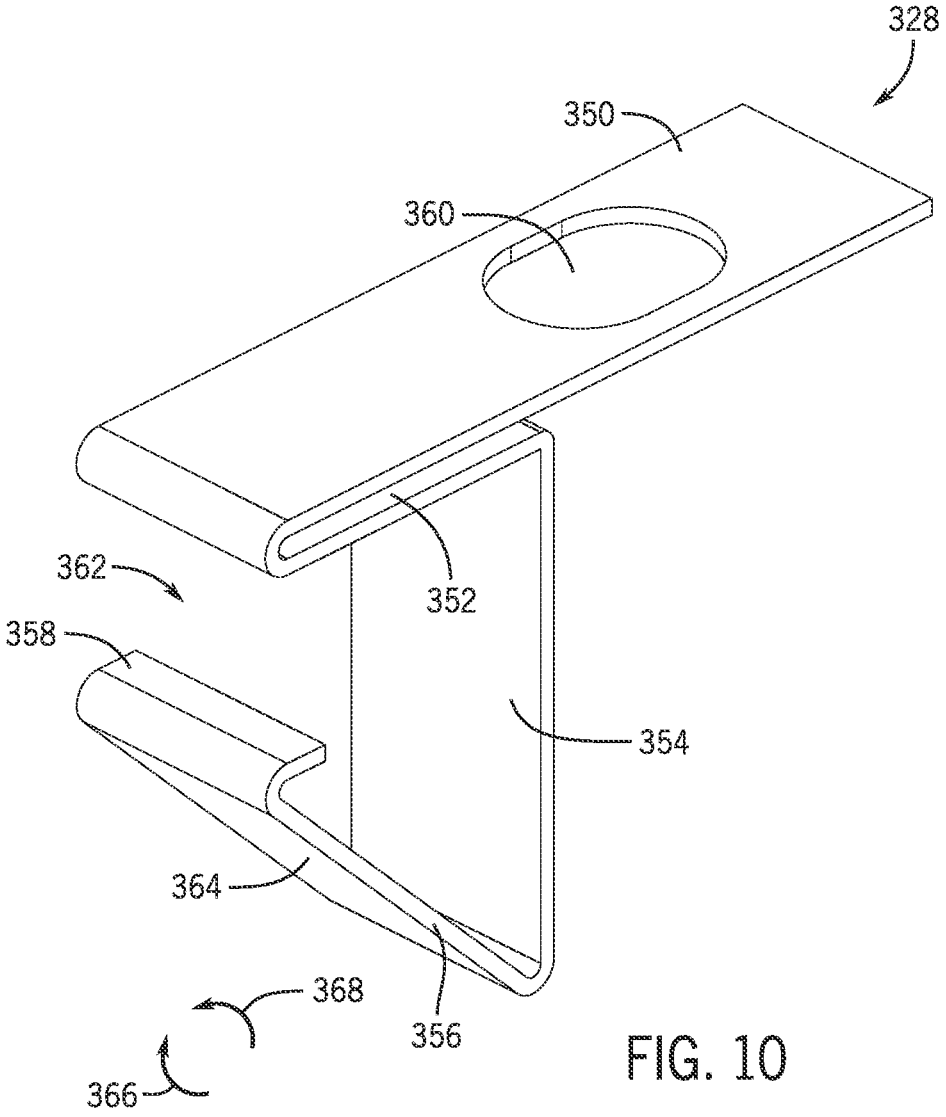
FIG. 10 is a perspective view of an embodiment of a latch that may be incorporated in a damper assembly, in accordance with an aspect of the present disclosure.

FIG. 10 is a perspective view of an embodiment of the latch 328. The latch 328 may include a first segment 350 (e.g., a base segment), a second segment 352 extending from the first segment 350, a third segment 354 extending from the second segment 352, a fourth segment 356 extending from the third segment 354, and a fifth segment 358 extending from the fourth segment 356. The first segment 350 may include a hole or aperture 360 to facilitate securement of the first segment 350, and therefore of the latch 328, to one of the damper blades 320, 322. As an example, the aperture 360 may be configured to receive a fastener that biases the first segment 350 and the damper blade 320, 322 against one another in the installed configuration of the latch 328.

The second segment 352, the third segment 354, and the fourth segment 356 may define a recess 362 configured to receive the protrusion 330 of the frame 312 in the closed position of the damper blade 320, 322. For example, the second segment 352 may extend along the first segment 350, the third segment 354 may extend away from the first segment 350 and the second segment 352 (e.g., at a perpendicular angle relative to the second segment 352, in a crosswise direction relative to the second segment 352), and the fourth segment 356 may extend in a direction generally toward the first segment 350 and the second segment 352 (e.g., at an acute angle relative to the third segment 354). In this manner, the second segment 352, the third segment 354, and the fourth segment 356 may form a hook-like shape or configuration. The orientation of the fourth segment 356 relative to the third segment 354 may also enable deformation (e.g., bending) of the fourth segment 356 when the protrusion 330 contacts an outer surface 364 of the fourth segment 356 during transition of the damper blade 320, 322 having the latch 328 to the closed position. For example, the angle between the fourth segment 356 and the third segment 354 may enable the protrusion 330 to force (e.g., elastically deform, bend, pivot, or rotate) the fourth segment 356 toward the third segment 354 in a first rotational direction 366 (e.g., toward the third segment 354). Such biasing of the fourth segment 356 may enable the protrusion 330 to transition along the fourth segment 356 and guide the protrusion 330 to extend into the recess 362.

Once the protrusion 330 is positioned within the recess 362, elastic deformation and/or a spring force of the fourth segment 356 may cause the fourth segment 356 to return to the configuration or position shown in the illustrated embodiment. Thus, the latch 328 may be oriented to retain the protrusion 330 within the recess 362. As an example, the fourth segment 356 and the fifth segment 358 may overlap with the protrusion 330 in the closed position of the damper blade 320, 322. Thus, the fourth segment 356 and the fifth segment 358 may block movement of the damper blade 320, 322 out of the recess 362 and toward the open position. The fourth segment 356 may resist bending or pivoting about the third segment 354 in a second rotational direction 368 (e.g., away from the third segment 354) caused by the protrusion 330 (e.g., during movement of the damper blade 320, 322 away from the protrusion 330). Accordingly, the fourth segment 356 may block the protrusion 330 from being removed from the recess 362. In addition, the fifth segment 358, which may extend toward the third segment 354, may increase a surface area of contact between the latch 328 and the protrusion 330 during movement of the damper blade 320, 322 away from the protrusion 330 and further block rotation of the fourth segment 356 about the third segment 354 in the second rotational direction 368. As such, the latch 328 may maintain the damper blade 320, 322 in the closed position.

Figure 11:
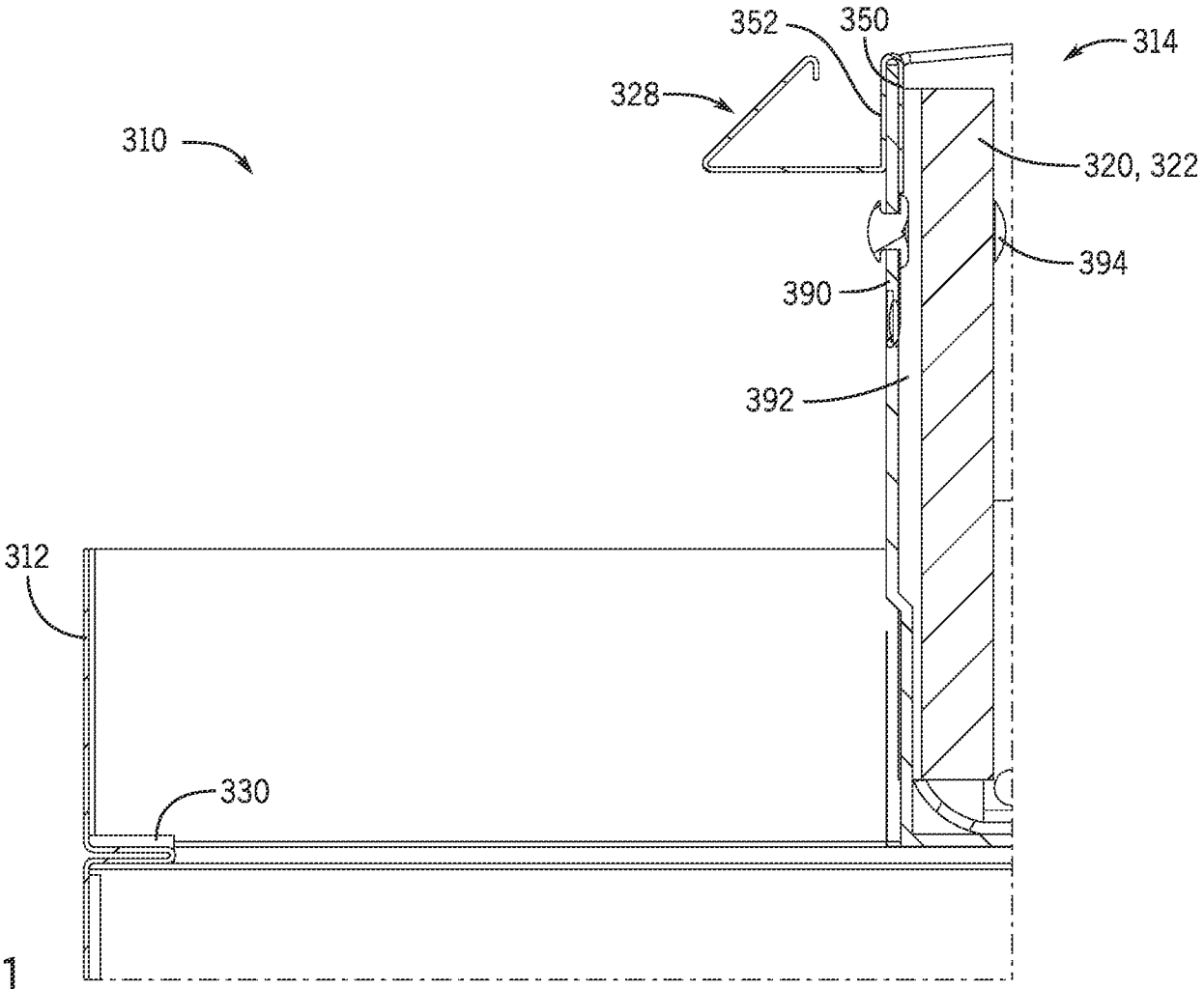
FIG. 11 is a partial side view of an embodiment of a damper assembly, illustrating a damper blade of a blade assembly in an open position, in accordance with an aspect of the present disclosure.

FIG. 11 is a partial side view of an embodiment of the damper assembly 310 in the open configuration. In the illustrated embodiment, the latch 328 is in the installed configuration in which the first segment 350 of the latch 328 is inserted into a gap formed between a panel 390 of the damper blade 320, 322 and a support 392 of the blade assembly 314. The second segment 352 of the latch 328 may extend along (e.g., abut) the panel 390 in the installed configuration. Thus, the first segment 350 and the second segment 352 may capture the panel 390 of the damper blade 320, 322 in order to secure the latch 328 to the damper blade 320, 322. Furthermore, a fastener 394 may be inserted through the latch 328 and further secure the latch 328 to the damper blade 320, 322. For example, in the installed configuration, the aperture 360 of the first segment 350 may align with corresponding holes or apertures of the damper blade 320, 322, and the fastener 394 may be inserted through the aligned apertures (e.g., through the first segment 350 and the damper blade 320, 322). The fastener 394 may bias the first segment 350 and the damper blade 320, 322 against one another, thereby restricting movement between the latch 328 and the damper blade 320, 322 to couple the latch 328 to the damper blade 320, 322. In additional or alternative embodiments, other features or components, such as a weld, a formation (e.g., a punched louver), an adhesive, or other securement feature, may be used to couple the latch 328 to the damper blade 320, 322.

Figure 12:
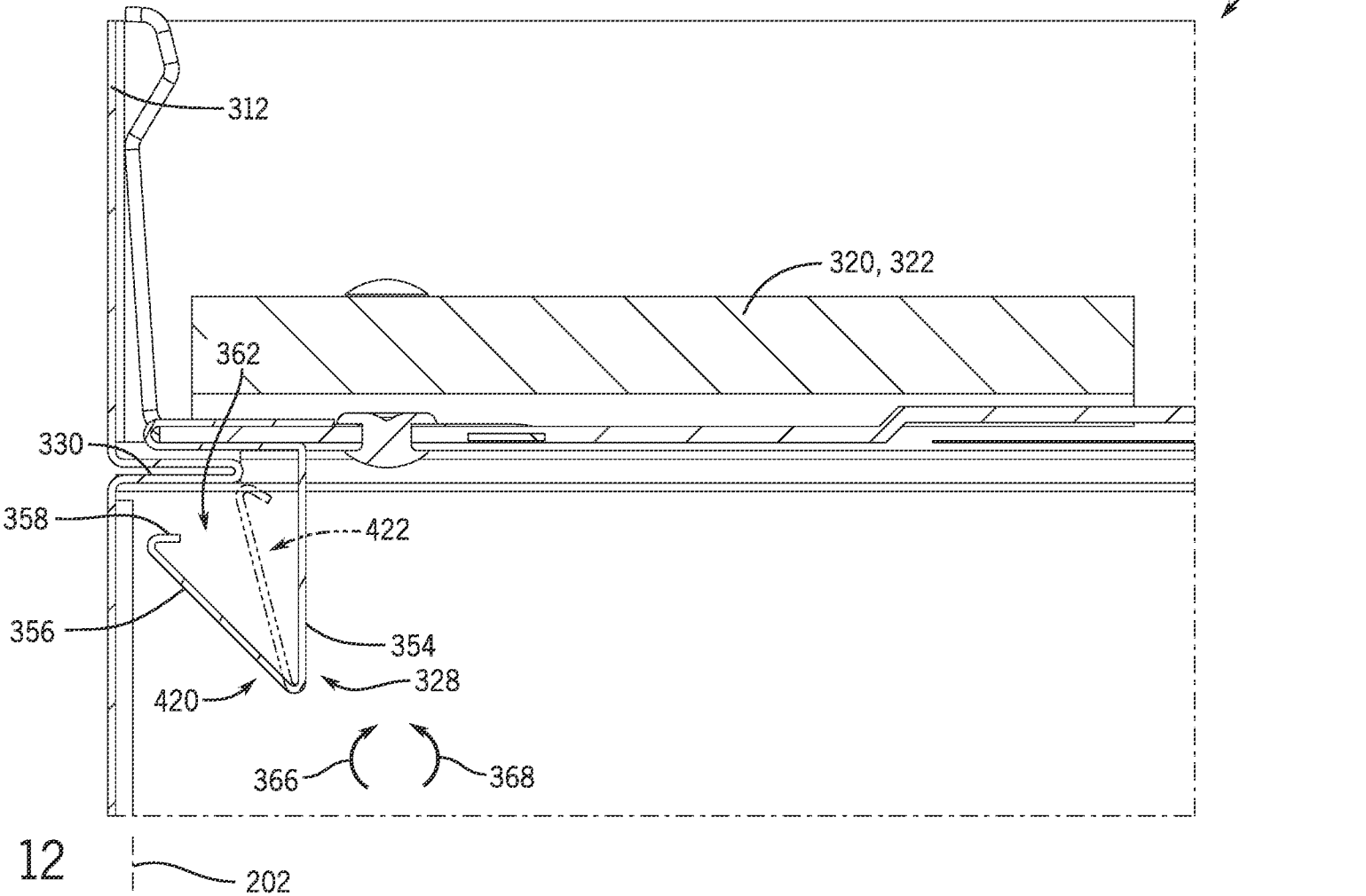
FIG. 12 is a partial side view of an embodiment of a damper assembly, illustrating a damper blade of a blade assembly in a closed position, in accordance with an aspect of the present disclosure.

FIG. 12 is a partial side view of the damper assembly 310 in the closed configuration, illustrating the protrusion 330 inserted within and/or extending into the recess 362 of the latch 328. In an expanded configuration 420 of the latch 328, the fourth segment 356 and/or the fifth segment 358 may overlap with the protrusion 330 (e.g., along vertical axis 202). Thus, rotation of the latch 328 relative to the protrusion 330 (e.g., in the first rotational direction 366 caused by movement of the damper blade 320, 322 away from the protrusion 330) may cause the fourth segment 356 and/or the fifth segment 358 to abut the protrusion 330, thereby blocking removal of the protrusion 330 from the recess 362. Thus, the expanded configuration 420 of the latch 328 may enable retention of the damper blade 320, 322 in the closed position. The latch 328 may also be deformed (e.g., via a manually applied force) to transition to a deformed configuration 422 shown in phantom lines. For example, the fourth segment 356 may be biased or forced (e.g., bent, rotated, pivoted) in the first rotational direction 366 relative to the third segment 354 to transition the latch 328 from the expanded configuration 420 to the deformed configuration 422. In the deformed configuration 422, the fourth segment 356 and the fifth segment 358 may be offset from the protrusion 330 and may therefore enable transition of the latch 328 (e.g., of the fourth segment 356, of the fifth segment 358) past the protrusion 330 In other words, in the deformed configuration 422, the fourth segment 356 and the fifth segment 358 may not block relative movement between the damper blade 320, 322 and the protrusion 330 (e.g., movement of the damper blade 320, 322 away from the protrusion 330). Thus, the deformed configuration 422 of the latch 328 may enable the damper blade 320, 322 to transition between the open position and the closed position.

It should be noted that the latch 328 may elastically deform to transition from the expanded configuration 420 to the deformed configuration 422. Thus, absent a force imparted onto the fourth segment 356, the latch 328 may return to and/or remain in the expanded configuration 420. As an example, during transition of the damper blade 320, 322 from the open position to the closed position, the latch 328 may transition from the expanded configuration 420 to the deformed configuration 422 via a force applied to the fourth segment 356 (e.g., by a user, by the protrusion 330) to enable transition of the latch 328 past the recess 362 and extension of the protrusion 330 into the recess 362. With the protrusion 330 extending into the recess 362, the force may no longer be applied (e.g., via the protrusion 330) to the fourth segment 356, and the latch 328 may therefore transition from the deformed configuration 422 to the expanded configuration 420 (e.g., with the protrusion 330 extending within the recess 362). Indeed, with the protrusion 330 extending into the recess 362, the fourth segment 356 and the fifth segment 358 may overlap with the protrusion 330, and the fourth segment 356 and/or the fifth segment 358 may block the latch 328 from transitioning past the protrusion 330 (e.g., in the first rotational direction 366). Thus, the latch 328 may enable retention of the damper blade 320, 322 in the closed position. To transition the damper blade 320, 322 from the closed position to the open position, a force may be applied (e.g., via a user) to the latch 328 (e.g., to the fourth segment 356) to transition the latch 328 from the expanded configuration 420 to the deformed configuration 422, such that the damper blade 320, 322 and the latch 328 may be rotated in the first rotational direction 366 past the protrusion 330 and toward the open position.

Figure 13:
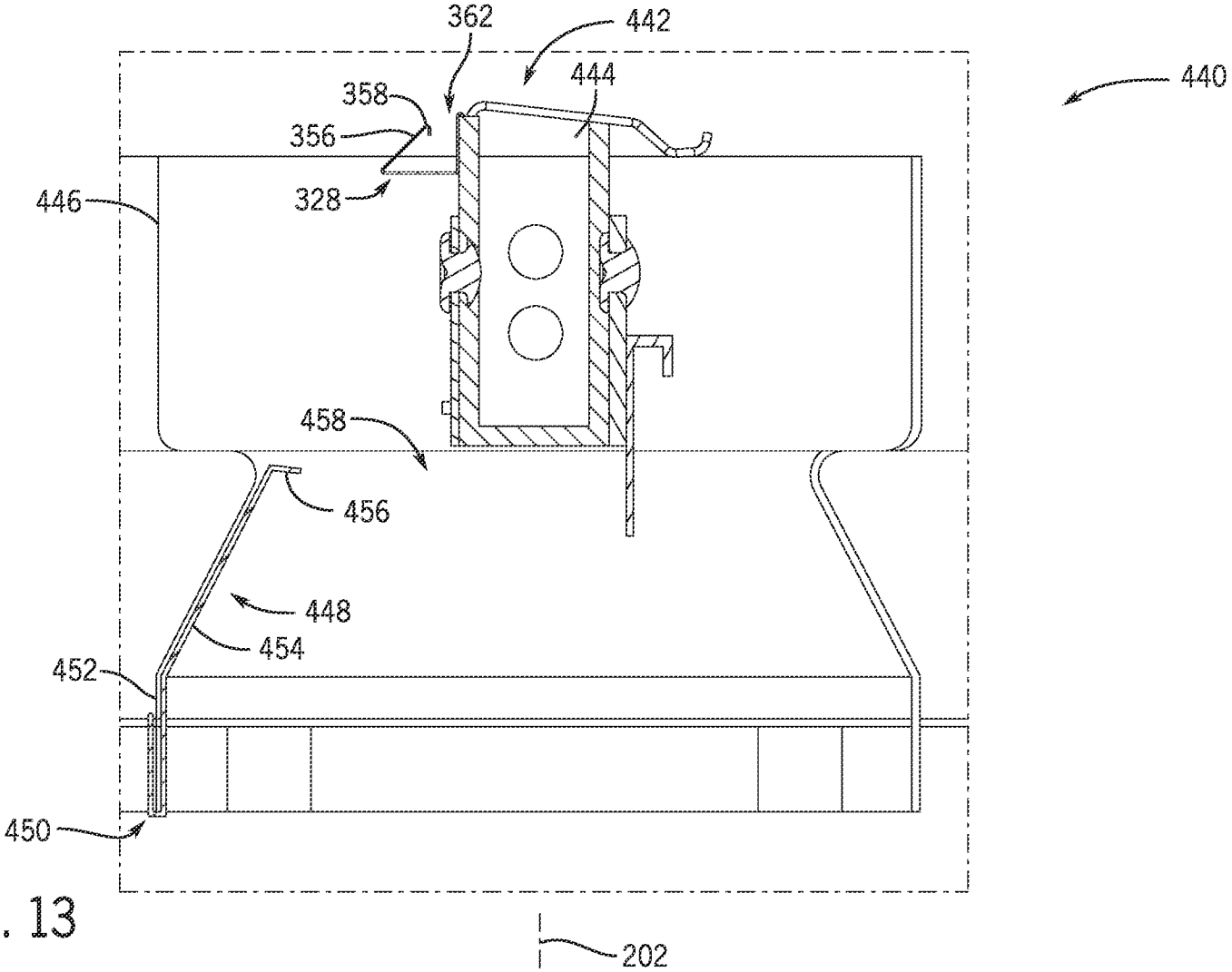
FIG. 13 is a cross-sectional side view of an embodiment of a damper assembly, illustrating a damper blade of a blade assembly in an open position, in accordance with an aspect of the present disclosure.

FIG. 13 is a cross-sectional side view of an embodiment of a damper assembly 440 having a blade assembly 442 with a damper blade 444 and the latch 328 coupled to the damper blade 444. The damper assembly 440 may include a frame 446 that may not include a protrusion for the latch 328 to capture in the closed position of the damper blade 444. For this reason, the damper assembly 440 may include a clip 448 (e.g., retainer, extension) configured to couple to the frame 446 to facilitate positioning of the damper blade 444 in the closed position. For instance, the clip 448 may be coupled to the frame 446 in an installed configuration of the clip 448. By way of example, the clip 448 may include a hook portion 450 configured to capture an edge 452 of the frame 446. Thus, the hook portion 450 may block relative movement between the clip 448 and the frame 446. In additional or alternative embodiments, the hook portion 450 may be secured to the frame 446 using other components or features, such as a fastener, a weld, an adhesive, a formation (e.g., a punch), or any combination thereof.

The clip 448 may also include a base portion 454 that extends along the frame 446 in the installed configuration. The clip 448 may also include a protrusion 456 that extends from the base portion 454 and away from the frame 446 (e.g., toward or into an opening 458 of the frame 446) in the installed configuration. The latch 328 may be configured to capture and/or engage with the protrusion 456 in the closed position of the damper blade 444, thereby blocking relative movement between the damper blade 444 and the clip 448 and therefore between the damper blade 444 and the frame 446. Accordingly, the engagement between the latch 328 and the clip 448 may retain the damper assembly 440 in the closed configuration. For example, in the expanded configuration 420 of the latch 328 with the protrusion 456 extending into the recess 362 of the latch 328, the fourth segment 356 and/or the fifth segment 358 of the latch 328 may overlap with the protrusion 456 (e.g., along vertical axis 202). Thus, the fourth segment 356 and/or the fifth segment 358 may block the latch 328 from transitioning past the protrusion 456 and thereby block rotation of the damper blade 444 away from the protrusion 456 toward the open position. In this manner, the latch 328 may retain the damper blade 444 in the closed position. Further, in the deformed configuration 422 of the latch 328, the fourth segment 356 and the fifth segment 358 may be offset from the protrusion 456 and may enable the latch 328 (e.g., the fourth segment 356, the fifth segment 358) to transition past the protrusion 456, thereby enabling the damper blade 444 to move between the open position and the closed position.

Figure 14:
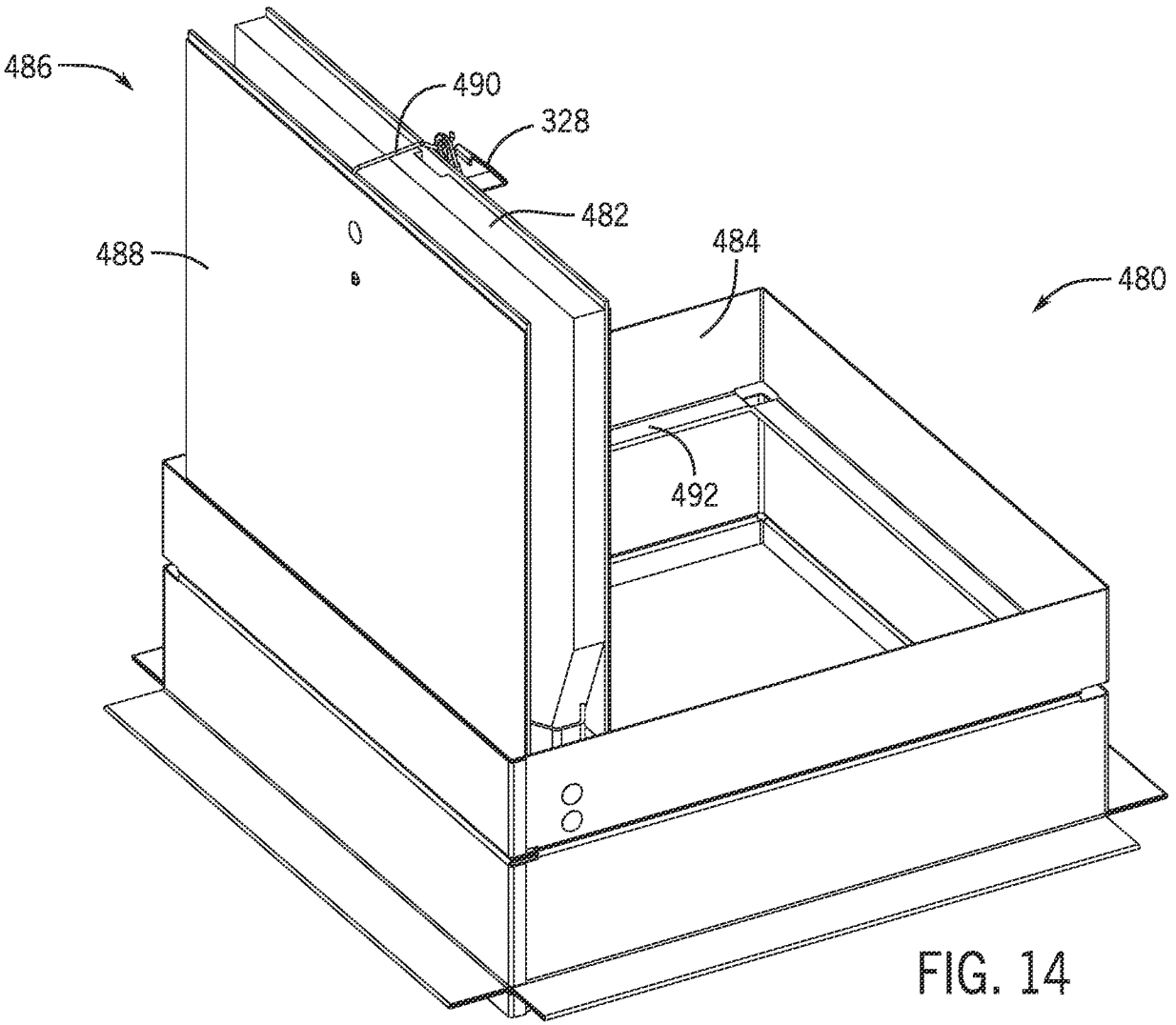
FIG. 14 is a perspective view of an embodiment of a damper assembly that may be incorporated in an HVAC system, in accordance with an aspect of the present disclosure.

FIG. 14 is a perspective view of an embodiment of a damper assembly 480 having a single damper blade 482. The damper assembly 480 may include a frame 484 and a blade assembly 486 that includes the single damper blade 482. The damper assembly 480 may also include a backing 488 fixedly coupled to the frame 484, as well as a link 490 that may couple the damper blade 482 to the backing 488 (e.g., bias the damper blade 482 toward, adjacent, and/or against the backing 488). Additionally, the latch 328 may be coupled to the damper blade 482. When the damper blade 482 transitions to the closed position (e.g., upon deformation of the link 490), the latch 328 may capture and retain a protrusion 492 of the frame 484 to block relative movement between the damper blade 482 and the frame 484. Thus, the latch 328 may retain the damper blade 482 in the closed position. Further, the latch 328 may enable transition of the damper blade 482 from the closed position to the open position upon transitioning the latch 328 to the deformed configuration 422 (e.g., via a manually applied force) and a force applied to the damper blade 482. Therefore, the latch 328 may enable the blade assembly 486 to facilitate desired positioning in the closed position or in the open position.

The present disclosure may provide one or more technical effects useful in the operation of an HVAC system. For example, the HVAC system may include a damper assembly that may enable or block air flow through ductwork of the HVAC system. The damper assembly may include a frame and a damper blade. The frame may form an opening through which air may flow, and the damper blade may transition between an open position, whereby air flow through the opening is enabled, and a closed position, whereby air flow through the opening is blocked. The damper assembly may also include a latch configured to maintain the damper blade in the closed position. For instance, in some embodiments, the latch may be coupled to the frame and may form a recess that captures the damper blade in the closed position of the damper blade to block movement of the damper blade relative to the frame. In additional or alternative embodiments, the latch may be coupled to the damper blade and may form a recess that captures a portion of the frame in the closed position of the damper blade to block movement of the damper blade relative to the frame. Thus, the latch may retain the damper blade in the closed position, such as upon impingement of an air flow against the damper blade. Further, the latch may be configured to deform to facilitate transition of the damper blade between the open position and the closed position. For example, a sufficient force (e.g., a manually applied force) may cause elastic deformation of the latch into a configuration that enables the damper blade to move relative to the frame and transition between the closed position and the open position. Thus, the latch may enable the damper blade to be positioned as desired. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A damper assembly, comprising:

a frame comprising an inner surface and a protrusion extending inwardly relative to the inner surface;

a damper blade coupled to the frame, wherein the damper blade is configured to transition between an open position and a closed position; and a latch coupled to the frame, wherein the latch is configured to deform to facilitate transition of the damper blade between the open position and the closed position and to expand to capture and retain the damper blade in the closed position, the latch comprises a tab segment configured to move toward the protrusion during deformation of the latch and to move away from the protrusion during expansion of the latch, a length of the tab segment is less than a thickness of the protrusion, and a distal end of the tab segment overlaps with the thickness of the protrusion.

2. The damper assembly of claim 1, wherein the latch comprises a first segment extending along the inner surface of the frame and a second segment extending from the first segment away from the inner surface, wherein the second segment is arcuate.

3. The damper assembly of claim 2, wherein the latch comprises a third segment extending from the second segment toward the inner surface and a fourth segment extending from the third segment toward the protrusion, the third segment and the fourth segment at least partially form a recess, and the recess is configured to capture the damper blade in the closed position.

4. The damper assembly of claim 3, wherein the third segment overlaps with the damper blade in the closed position.

5. The damper assembly of claim 3, wherein the fourth segment is disposed at an angle relative to the inner surface of the frame in an expanded configuration of the latch.

6. The damper assembly of claim 5, wherein the latch comprises a fifth segment extending from the fourth segment away from the inner surface of the frame, wherein the fifth segment is configured to translate along the protrusion during deformation and expansion of the latch.

7. The damper assembly of claim 6, wherein the tab segment extends from the fifth segment.

8. The damper assembly of claim 7, wherein the latch is secured to the frame via a fastener, a formation of the frame, or both.

9. A latch for a damper assembly, the latch comprising:

a first segment configured to be secured to a frame of the damper assembly;

a second segment extending from the first segment and configured to extend away from an inner surface of the frame in an installed configuration of the latch with the damper assembly, wherein the second segment is configured to move relative to the first segment in the installed configuration;

a third segment extending from the second segment and configured to extend toward the inner surface of the frame in the installed configuration; and a fourth segment extending from the third segment, wherein the fourth segment is configured to extend at an oblique angle relative to the inner surface of the frame in the installed configuration, wherein the third segment and the fourth segment at least partially define a recess of the latch, and the recess is configured to capture and retain a damper blade of the damper assembly in a closed position of the damper blade.

10. The latch of claim 9, wherein the fourth segment is configured to extend along and abut the inner surface of the frame to enable transition of the damper blade between the closed position and an open position in the installed configuration.

11. The latch of claim 9, comprising a fifth segment extending from the fourth segment and configured to extend away from the inner surface in the installed configuration, wherein the third segment, the fourth segment, and the fifth segment form the recess configured to capture and retain the damper blade in the closed position.

12. The latch of claim 11, comprising a sixth segment extending crosswise from the fifth segment, wherein the sixth segment is configured to enable transition of the latch from an expanded configuration to a deformed configuration to enable release of the damper blade from the recess.

13. The latch of claim 12, wherein transition of the latch between the expanded configuration and the deformed configuration causes bending of the fourth segment relative to the second segment and the third segment.

14. The latch of claim 9, wherein the second segment is configured to contact and guide the damper blade into the recess during transition of the damper blade from an open position to the closed position in the installed configuration.

15. A damper assembly, comprising:

a frame defining an air flow path of the damper assembly, wherein the frame comprises an inner surface and a protrusion extending from the inner surface and into the air flow path;

a blade assembly coupled to the frame and comprising a damper blade configured to rotate relative to the frame to transition between an open configuration and a closed configuration; and a latch comprising a first end and a second end, wherein the first end is secured to the frame, the second end is configured to move relative to the first end, the second end comprises a tab segment having a length less than a thickness of the protrusion, such that a distal end of the tab segment overlaps with the thickness of the protrusion, and the latch is configured to capture and retain the damper blade in the closed configuration.

16. The damper assembly of claim 15, wherein the latch defines a recess configured to receive the damper blade and retain the damper blade in the closed configuration.

17. The damper assembly of claim 16, wherein a segment of the latch defining the recess is configured to extend along and abut the inner surface in a deformed configuration of the latch, and wherein, in the deformed configuration, the latch enables transition of the damper blade between the closed configuration and the open configuration.

18. The damper assembly of claim 17, wherein the segment is disposed at an angle relative to the inner surface of the frame in an expanded configuration, and the latch retains the damper blade within the recess in the expanded configuration.

19. The damper assembly of claim 18, wherein the distal end of the tab segment enables manual actuation of the latch from the expanded configuration to the deformed configuration.

20. The damper assembly of claim 15, wherein the latch comprises a segment extending between the first end and the second end and away from the inner surface of the frame, the segment is arcuate, the segment is configured to guide the damper blade into a recess of the latch during transition of the damper blade from the open configuration to the closed configuration, and the latch is configured to retain the damper blade within the recess and in the closed configuration.

* * * * *